US009409417B2

(12) United States Patent
Soda et al.

(10) Patent No.: US 9,409,417 B2
(45) Date of Patent: Aug. 9, 2016

(54) CONVEYOR DEVICE AND INKJET RECORDING APPARATUS

(71) Applicant: KYOCERA Document Solutions Inc., Osaka (JP)

(72) Inventors: Tomohisa Soda, Osaka (JP); Takeshi Watanabe, Osaka (JP); Hidenori Takenaka, Osaka (JP); Jumpei Hobo, Osaka (JP); Masami Fujihara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/674,733

(22) Filed: Mar. 31, 2015

(65) Prior Publication Data

US 2015/0273877 A1 Oct. 1, 2015

(30) Foreign Application Priority Data

Apr. 1, 2014 (JP) ..... 2014-075588

(51) Int. Cl.
*B41J 11/00* (2006.01)

(52) U.S. Cl.
CPC ..... *B41J 11/007* (2013.01); *B41J 11/005* (2013.01); *B41J 11/0085* (2013.01)

(58) Field of Classification Search
CPC .. B41J 11/007; B41J 11/0085; B41J 11/0045; B41J 11/005; B41J 2/245; B41J 2/155; B41J 2/515; B41J 11/20; B41J 11/06
USPC ..... 347/101, 104
See application file for complete search history.

(56) References Cited

U.S. PATENT DOCUMENTS

| | | | | |
|---|---|---|---|---|
| 7,093,933 | B2 | 8/2006 | Tsuji et al. | |
| 2004/0169711 | A1 | 9/2004 | Tsuji et al. | |
| 2007/0291096 | A1* | 12/2007 | Toyoshima | B41J 11/0025 347/104 |
| 2009/0251521 | A1* | 10/2009 | Arai | B41J 3/28 347/104 |
| 2011/0242220 | A1* | 10/2011 | Yamagishi | B41J 11/0085 347/47 |
| 2011/0293346 | A1* | 12/2011 | Sato | B41J 11/0085 400/578 |
| 2012/0050398 | A1* | 3/2012 | Yamagishi | B41J 11/007 347/30 |
| 2012/0056925 | A1* | 3/2012 | Yamagishi | B41J 2/155 347/14 |
| 2012/0069085 | A1* | 3/2012 | Yamagishi | B41J 2/1714 347/30 |

FOREIGN PATENT DOCUMENTS

JP 2004-216653 A 8/2004

* cited by examiner

*Primary Examiner* — Matthew Luu
*Assistant Examiner* — Patrick King
(74) *Attorney, Agent, or Firm* — Studebaker & Brackett PC

(57) ABSTRACT

A conveyor device includes a guide member with through holes therein. The guide member has a surface with grooves therein. The through holes are located inside of the grooves. The through holes include a first through hole and a second through hole. The first through hole is located opposite to an ejection region of a recording head. The second through hole is located opposite to a non-ejection region of the recording head. The grooves include a first groove and a second groove. The first through hole is located inside of the first groove. The second through hole is located inside of the second groove. The second groove is longer than the first groove.

7 Claims, 21 Drawing Sheets

CONVEYOR DEVICE AND INKJET RECORDING APPARATUS

INCORPORATION BY REFERENCE

The present application claims priority under 35 U.S.C. §119 to Japanese Patent Application No. 2014-075588, filed Apr. 1, 2014. The contents of this application are incorporated herein by reference in their entirety.

BACKGROUND

The present disclosure relates to a conveyor device for installation in a recording apparatus and an inkjet recording apparatus including the conveyor device.

An inkjet recording apparatus is a commonly known type of recording apparatus. Inkjet recording apparatuses are widely used in machines such as printers, copiers, and multifunction peripherals due to their compactness, low cost, and low operating noise. Inkjet recording apparatuses are broadly classified as being either a line head or a serial head type.

A line head inkjet recording apparatus includes a conveyor device for conveying a recording medium. The conveyor device typically includes a conveyor belt. The conveyor device is located opposite to a recording head and holds a recording medium on the conveyor belt while conveying the recording medium. The recording medium is held on the conveyor belt by using static electricity to attract the recording medium or negative pressure to suck the recording medium.

A conveyor device that creates negative pressure includes a suction section that sucks on the recording medium through the conveyor belt. The conveyor belt has a plurality of suction holes perforated therein. The suction section includes a guide member that supports the recording medium through the conveyor belt. The guide member has through holes that run through the guide member in a thickness direction thereof. The suction section creates negative pressure and thereby sucks air through the suction holes in the conveyor belt and through the through holes in the guide member. Through the above, the recording medium is sucked onto the conveyor belt. Unfortunately, a conveyor device having the configuration described above suffers from the following problem.

Namely, when a recording medium having paper dust attached thereto is conveyed to a position opposite to the recording head, the paper dust may be stirred up by suction air flow (air current) and may become attached to the nozzle orifice. As a consequence, the nozzle orifice may unfortunately become clogged by the attached paper dust. The suction air flow is created by the negative pressure that is used to suck the recording medium onto the conveyor belt. Clogging of the nozzle orifice makes it difficult for the nozzle orifice to eject ink droplets and may result in formation of an image that has white lines along a conveyance direction of the recording medium.

Attachment of paper dust to the nozzle orifice can be prevented by making suction air flow that is created below the recording head smaller. In one example of a serial head inkjet recording apparatus, the guide member does not have through holes at either end in a main scanning direction of a region in which ink droplets are ejected.

The main scanning direction is perpendicular to a recording medium conveyance direction. The above configuration enables suction air flow that is created in the region in which ink droplets are ejected to be made smaller.

SUMMARY

A conveyor device according to an aspect of the present disclosure is for installation opposite to a recording head in a recording apparatus. The conveyor device includes a conveyor belt and a suction section. The conveyor belt conveys a recording medium. The suction section includes a guide member having a plurality of through holes therein. The guide member is located opposite to the recording head with the conveyor belt therebetween. The suction section sucks on the recording medium through the conveyor belt and the guide member. The guide member has a surface with a plurality of grooves therein that faces toward the recording head with the conveyor belt therebetween. The through holes are each located inside of a corresponding one of the grooves. The through holes include a first through hole within a first region of the guide member and a second through hole within a second region of the guide member. The first region is located opposite to an ejection region of the recording head. The second region is located opposite to a non-ejection region of the recording head. The grooves include a first groove and a second groove. The first through hole is located inside of the first groove. The second through hole is located inside of the second groove. The second groove is longer than the first groove.

A conveyor device according to another aspect of the present disclosure is for installation opposite to a recording head in a recording apparatus. The conveyor device includes a conveyor belt and a suction section. The conveyor belt conveys a recording medium. The suction section includes a guide member having a plurality of through holes therein. The guide member is located opposite to the recording head with the conveyor belt therebetween. The suction section sucks on the recording medium through the conveyor belt and the guide member. The guide member has a surface with a plurality of grooves therein that faces toward the recording head with the conveyor belt therebetween. The through holes are each located inside of a corresponding one of the grooves and outside of a first region of the guide member. The first region is located opposite to an ejection region of the recording head. The through holes include a first through hole and a second through hole. The first through hole is located outside of a head facing region of the guide member and the second through hole is located within a second region of the guide member. The second region is located opposite to a non-ejection region of the recording head. The grooves include a first groove and a second groove. The first through hole is located inside of the first groove. The second through hole is located inside of the second groove. The first groove includes a section located outside of the head facing region and a section located within the first region.

A conveyor device according to another aspect of the present disclosure is for installation opposite to a recording head in a recording apparatus. The conveyor device includes a conveyor belt and a suction section. The conveyor belt conveys a recording medium. The suction section includes a guide member having a plurality of through holes therein. The guide member is located opposite to the recording head with the conveyor belt therebetween. The suction section sucks on the recording medium through the conveyor belt and the guide member. The through holes include a first through hole within a first region of the guide member and a second through hole within a second region of the guide member. The first region is located opposite to an ejection region of the recording head. The second region is located opposite to a non-ejection region of the recording head. The guide member has a surface that faces toward the recording head with the conveyor belt therebetween and that has a groove therein. The second through hole is located inside of the groove and the first through hole is located outside of the groove.

An inkjet recording apparatus according to another aspect of the present disclosure includes a recording head and any one of the conveyor devices described above. The recording head ejects ink droplets.

DETAILED DESCRIPTION

Figure 1:
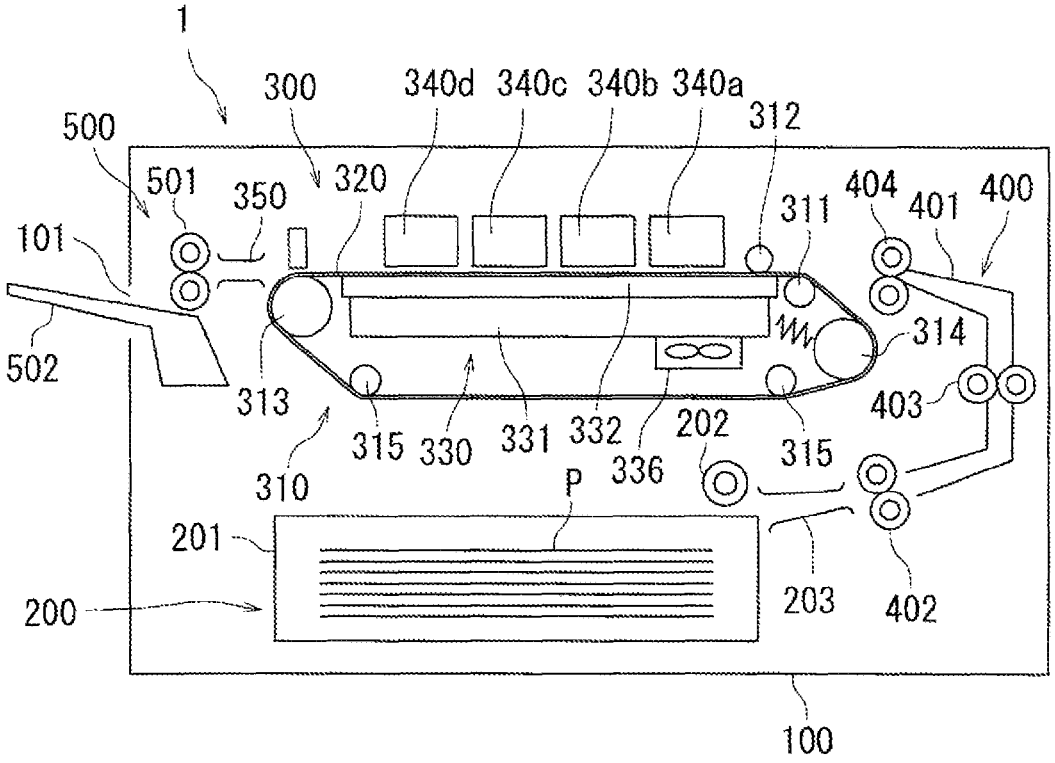
FIG. 1 illustrates configuration of an inkjet recording apparatus including a conveyor device according to a first embodiment of the present disclosure.

The following explains embodiments of the present disclosure with reference to the drawings. Elements that are the same or equivalent are indicated by the same reference signs in the drawings and explanation thereof is not repeated. The drawings are schematic illustrations that emphasize elements of configuration in order to facilitate understanding thereof. Therefore, in order that the elements can be easily illustrated in the drawings, properties of each of the elements, such as thickness, length, and number thereof, may differ from actual properties of the element. Also note that material properties, shapes, dimensions, and the like, described for each of the elements of configuration in the following embodiments, are only examples and are not intended to impose any particular limitations on the elements.

First Embodiment

[Basic Configuration of Inkjet Recording Apparatus 1]

FIG. 1 illustrates configuration of an inkjet recording apparatus 1 including a conveyor device 310 according to a first embodiment of the present disclosure.

The inkjet recording apparatus 1 (an example of a recording apparatus) includes a housing 100, a sheet feed section 200, an image forming section 300 that uses an inkjet recording method, a sheet conveying section 400, and a sheet ejecting section 500. The sheet feed section 200 is located in a lower section of the housing 100. The image forming section 300 is located above the sheet feed section 200. The sheet conveying section 400 is located at one side of the image forming section 300. The sheet ejecting section 500 is located at the other side of the image forming section 300.

The sheet feed section 200 includes a sheet feed cassette 201 that is freely detachable from the housing 100. The sheet feed section 200 also includes a sheet feed roller 202 and guide plates 203. The sheet feed roller 202 is located above the sheet feed cassette 201 at one end thereof. The guide plates 203 are located between the sheet feed roller 202 and the sheet conveying section 400.

The sheet feed cassette 201 contains a plurality of sheets of paper P (an example of a recording medium) in a stacked state. In the following explanation, a sheet of paper is simply referred to as a sheet. The sheet feed roller 202 (pick-up roller) is a feed member that feeds a sheet P in a conveyance direction thereof. The sheet feed roller 202 picks up sheets P, one at a time, from the sheet feed cassette 201. The guide plates 203 guide a sheet P that has been picked up by the sheet feed roller 202 to the sheet conveying section 400.

The sheet conveying section 400 includes a sheet conveyance path 401 that is roughly C-shaped, a first pair of conveyance rollers 402 (primary sheet feed roller pair), a second pair of conveyance rollers 403 (secondary sheet feed roller pair), and a pair of registration rollers 404. The first pair of conveyance rollers 402 is located at an input end of the sheet conveyance path 401. The second pair of conveyance rollers 403 is located partway along the sheet conveyance path 401. The pair of registration rollers 404 is located at an output end of the sheet conveyance path 401. The sheet conveyance path 401 forms one section of a conveyance path of the sheet P (an example of a recording medium conveyance path).

The first pair of conveyance rollers 402 is a feed member that feeds the sheet P in the conveyance direction thereof. The first pair of conveyance rollers 402 sandwiches the sheet P fed from the sheet feed section 200 therebetween and feeds the sheet P into the sheet conveyance path 401. The second pair of conveyance rollers 403 is also a feed member. The second pair of conveyance rollers 403 sandwiches the sheet P fed from the first pair of conveyance rollers 402 therebetween and feeds the sheet P in the sheet conveyance direction.

The pair of registration rollers 404 performs skew correction on the sheet P fed from the second pair of conveyance rollers 403. The pair of registration rollers 404 temporarily holds the sheet P stationary in order to synchronize conveyance of the sheet P with a timing at which image formation is to be performed on the sheet P. The pair of registration rollers 404 subsequently feeds the sheet P to the image forming section 300 in accordance with the timing of image formation on the sheet P.

The image forming section 300 includes the conveyor device 310, four types of line head 340*a*, 340*b*, 340*c*, and 340*d*, and a conveyance guide 350. The four types of line head 340*a*, 340*b*, 340*c*, and 340*d* are located above the conveyor device 310. The conveyance guide 350 is located downstream of the conveyor device 310 in terms of the conveyance direction of the sheet P. Although not illustrated in the drawings, the four types of line head 340*a*, 340*b*, 340*c*, and 340*d* each include a plurality of nozzles. The nozzles eject ink droplets in order to form an image, such as a diagram or text, on the sheet P. The image forming section 300 may also include a drying device. The drying device dries ink droplets that have landed onto the sheet P.

The conveyor device 310 includes a belt speed detecting roller 311, a sheet holding roller 312, a drive roller 313, a tension roller 314, a pair of guide rollers 315, an endless conveyor belt 320, and a suction section 330. The conveyor device 310 is located opposite to the four types of line head 340*a*, 340*b*, 340*c*, and 340*d* in the housing 100. The conveyor belt 320 is wound around the belt speed detecting roller 311, the drive roller 313, the tension roller 314, and the pair of guide rollers 315. The conveyor belt 320 is driven in the conveyance direction of the sheet P and thus conveys the sheet P in the aforementioned direction.

The conveyor belt 320 is for example made from a material such as polyimide (PI), polyamide-imide (PAI), polyvinylidene fluoride (PVDF), or polycarbonate (PC). Use of polyimide or polyamide-imide is preferable in terms of reducing unevenness in thickness of the conveyor belt 320. Also, a layer made of a rubber material such as ethylene propylene diene monomer (EPDM) rubber may be layered on a rear surface of the conveyor belt 320 (i.e., a surface facing the suction section 330). The conveyor belt has a thickness of, for example, 100 μm.

The tension roller 314 ensures that the conveyor belt 320 does not sag by applying tensile force to the conveyor belt 320. The conveyor device 310 may include a mechanism that when meandering of the conveyor belt 320 occurs, changes the orientation of the axial center of the tension roller 314 in accordance with the meandering. Such a mechanism corrects the meandering of the conveyor belt 320.

The belt speed detecting roller 311 is located upstream relative to the suction section 330 in terms of the conveyance direction of the sheet P. The belt speed detecting roller 311 rotates due to friction generated between the belt speed detecting roller 311 and the conveyor belt 320. The belt speed detecting roller 311 includes a pulse plate (not illustrated) that rotates integrally with the belt speed detecting roller 311. The circulation speed of the conveyor belt 320 is detected by measuring the rotation speed of the pulse plate. Therefore, when unevenness in circulation speed of the conveyor belt 320 occurs, the unevenness can be corrected by controlling the rotation speed of the drive roller 313.

The drive roller 313 is located downstream relative to the suction section 330 in terms of the conveyance direction of the sheet P. Preferably the drive roller 313 is located such as to function in combination with the belt speed detecting roller 311 to maintain flatness of the conveyor belt 320. Such a configuration also maintains flatness of the conveyor belt 320 when meandering correction is performed on the conveyor belt 320.

The drive roller 313 is driven by a motor (not illustrated). In other words, the motor causes the drive roller 313 to rotate. When the drive roller 313 rotates, friction generated between the drive roller 313 and the conveyor belt 320 causes the conveyor belt 320 to circulate in a direction corresponding to counter clockwise in FIG. 1. The drive roller 313 has a diameter of, for example, 30.0 mm.

In a configuration in which correction of unevenness of speed of the conveyor belt 320 is performed by correcting rotation speed of the drive roller 313, the drive roller 313 preferably has a small moment of inertia. In other words, the drive roller 313 is preferably light. In consideration of the above, in the first embodiment the drive roller 313 is preferably a hollow pipe such as an aluminum pipe or a pipe having a three-spoke cross-section. In a configuration in which unevenness of speed of the conveyor belt 320 is not corrected, the drive roller 313 preferably has a large moment of inertia in order to stabilize rotation of the drive roller 313 through a flywheel effect. In other words, the drive roller 313 is preferably heavy. Therefore, in such a configuration the drive roller 313 is preferably made of a material such as solid metal.

In a configuration in which the conveyor belt 320 is made from a resinous material such as polyimide, a surface layer of the drive roller 313 is preferably made from a rubber material such as EPDM rubber, urethane rubber, or nitrile rubber. In a configuration in which the image forming section 300 forms an image on the sheet P using an aqueous ink, EPDM rubber is preferably used as a material of the surface layer of the drive roller 313 in order to prevent swelling of the rubber material. The surface layer formed from the rubber material has a thickness of, for example, 1.0 mm. In a configuration in which a layer of a rubber material such as EPDM rubber is disposed over the rear surface of the conveyor belt 320, the surface layer of the drive roller 313 may be made from metal. In a configuration in which the surface layer of the drive roller 313 is made from aluminum, the surface of the drive roller 313 may be anodized in order to prevent abrasion.

The pair of guide rollers 315 is located lower than suction section 330. By positioning the pair of guide rollers 315 as described above, a space is formed under the suction section 330 and thus a section of the conveyor belt 320 that is located under the suction section 330 is prevented from coming into contact with the suction section 330. Also, a guide roller 315 among the pair of guide rollers 315 that is closer to the drive roller 313 maintains a degree to which the conveyor belt 320 is wound around the drive roller 313. A guide roller 315 among the pair of guide rollers 315 that is closer to the tension roller 314 maintains a degree to which the conveyor belt 320 is wound around the tension roller 314, thereby ensuring that meandering correction can be reliably performed.

The four types of line head 340*a*, 340*b*, 340*c*, and 340*d* are located in respective order from upstream to downstream in terms of the conveyance direction of the sheet P. The line heads 340*a*, 340*b*, 340*c*, and 340*d* each include a plurality of nozzles (not illustrated) that are arranged in a width direction of the conveyor belt 320 (i.e., a direction perpendicular to the conveyance direction of the sheet P). In other words, the inkjet recording apparatus 1 is a line head inkjet recording apparatus.

The following explains a generic line head inkjet recording apparatus. In order to eject ink droplets of a single color toward a recording medium, the line head inkjet recording apparatus includes a single recording head having a greater width than the recording medium. Alternatively, the line head inkjet recording apparatus may include a plurality of recording heads that are arranged in a direction perpendicular to the conveyance direction of the recording medium (i.e., arranged in a width direction of the recording medium). In a configuration in which the inkjet recording apparatus ejects ink droplets of a plurality of different colors, the inkjet recording apparatus includes either a single recording head or a group of recording heads for each of the colors, and the recording heads for the respective colors are arranged in the conveyance direction of the recording medium. The recording heads are fixed in place and the recording medium is conveyed under the recording heads. The recording heads form an image on the recording medium by ejecting ink droplets onto the recording medium while the recording medium is being conveyed. Note that in a serial head inkjet recording apparatus, a recording medium is held stationary partway along a recording medium conveyance path and recording heads eject ink droplets onto the stationary recording medium while moving.

The following resumes explanation of the inkjet recording apparatus 1 according to the first embodiment. The line head 340*a* includes a plurality of nozzles that are each in communication with a pressure chamber (not illustrated) located within a recording head. The pressure chamber is in communication with an ink chamber (not illustrated) located within the recording head. The ink chamber is in communication with a black (Bk) ink tank (not illustrated) via an ink supply tube (not illustrated). In other words, the ink chamber is connected to the black ink tank.

The line head 340*b* includes a plurality of nozzles that are each in communication with a pressure chamber (not illustrated) located within a recording head. The pressure chamber is in communication with an ink chamber (not illustrated) located within the recording head. The ink chamber is in communication with a cyan (C) ink tank (not illustrated) via an ink supply tube (not illustrated). In other words, the ink chamber is connected to the cyan ink tank.

The line head 340*c* includes a plurality of nozzles that are each in communication with a pressure chamber (not illustrated) located within a recording head. The pressure chamber is in communication with an ink chamber (not illustrated) located within the recording head. The ink chamber is in communication with a magenta (M) ink tank (not illustrated) via an ink supply tube (not illustrated). In other words, the ink chamber is connected to the magenta ink tank.

The line head 340*d* includes a plurality of nozzles that are each in communication with a pressure chamber (not illustrated) located within a recording head. The pressure chamber is in communication with an ink chamber (not illustrated) located within the recording head. The ink chamber is in communication with a yellow (Y) ink tank (not illustrated) via an ink supply tube (not illustrated). In other words, the ink chamber is connected to the yellow ink tank.

The suction section 330 faces the rear surface of the conveyor belt 320 such as to be located opposite to the four types of line head 340*a*, 340*b*, 340*c*, and 340*d* with the conveyor belt 320 therebetween. The suction section 330 includes an air flow chamber 331 (an example of a gas flow chamber), a guide member 332 that covers an upper surface aperture of the air flow chamber 331, and a suction device 336. The guide member 332 supports the sheet P through the conveyor belt 320.

The sheet holding roller 312 is a driven roller. The sheet holding roller 312 is located opposite to the guide member 332 with the conveyor belt 320 therebetween. The sheet holding roller 312 guides a sheet P that has been fed from the pair of registration rollers 404 onto the conveyor belt 320 and causes the sheet P to be sucked onto the conveyor belt 320.

The sheet holding roller 312 preferably has a small moment of inertia in order to soften impact vibration generated by the sheet P impacting with the sheet holding roller 312. In other words, the sheet holding roller 312 is preferably light. The sheet holding roller 312 is for example preferably a hollow pipe such as an aluminum pipe or a pipe having a three-spoke cross-section. In a configuration in which the sheet holding roller 312 is made from aluminum, the surface of the sheet holding roller 312 may be anodized in order to prevent abrasion.

In the first embodiment, pressing force that presses the sheet holding roller 312 toward the conveyor belt 320 (i.e., toward the guide member 332) is applied to the sheet holding roller 312. Through the above configuration, even when there is a disparity between the conveyance speed of the sheet P by the pair of registration rollers 404 and the circulation speed of the conveyor belt 320, a position at which close contact between the sheet P and the conveyor belt 320 begins can be made to correspond to a position at which the sheet holding roller 312 is located.

The suction device 336 is for example a fan. However, the suction device 336 is not limited to being a fan and may for example be a vacuum pump instead. While the suction device 336 is being operated, the suction section 330 sucks on the sheet P through the conveyor belt 320.

The conveyance guide 350 guides the sheet P to the sheet ejecting section 500 upon the sheet P being ejected from the conveyor belt 320. The sheet ejecting section 500 includes a pair of ejection rollers 501 and an exit tray 502. The exit tray 502 is fixed to the housing 100 such as to project outward from an exit port 101 formed in the housing 100.

Once the sheet P has passed through the conveyance guide 350, the sheet P is fed toward the exit port 101 by the pair of ejection rollers 501 and is guided onto the exit tray 502. As a result, the sheet P is ejected externally from the housing 100 through the exit port 101.

The air flow chamber 331 is formed by a box-shaped member having a covered bottom end and an open top end. The suction device 336 is located under the air flow chamber 331. A bottom wall of the box-shaped member forming the air flow chamber 331 has a gas outlet (not illustrated) corresponding to the suction device 336. The suction device 336 is connected to a power source (not illustrated). Operation of the suction device 336 creates negative pressure in the air flow chamber 331. The negative pressure causes suction on the sheet P through the conveyor belt 320.

Figure 2:
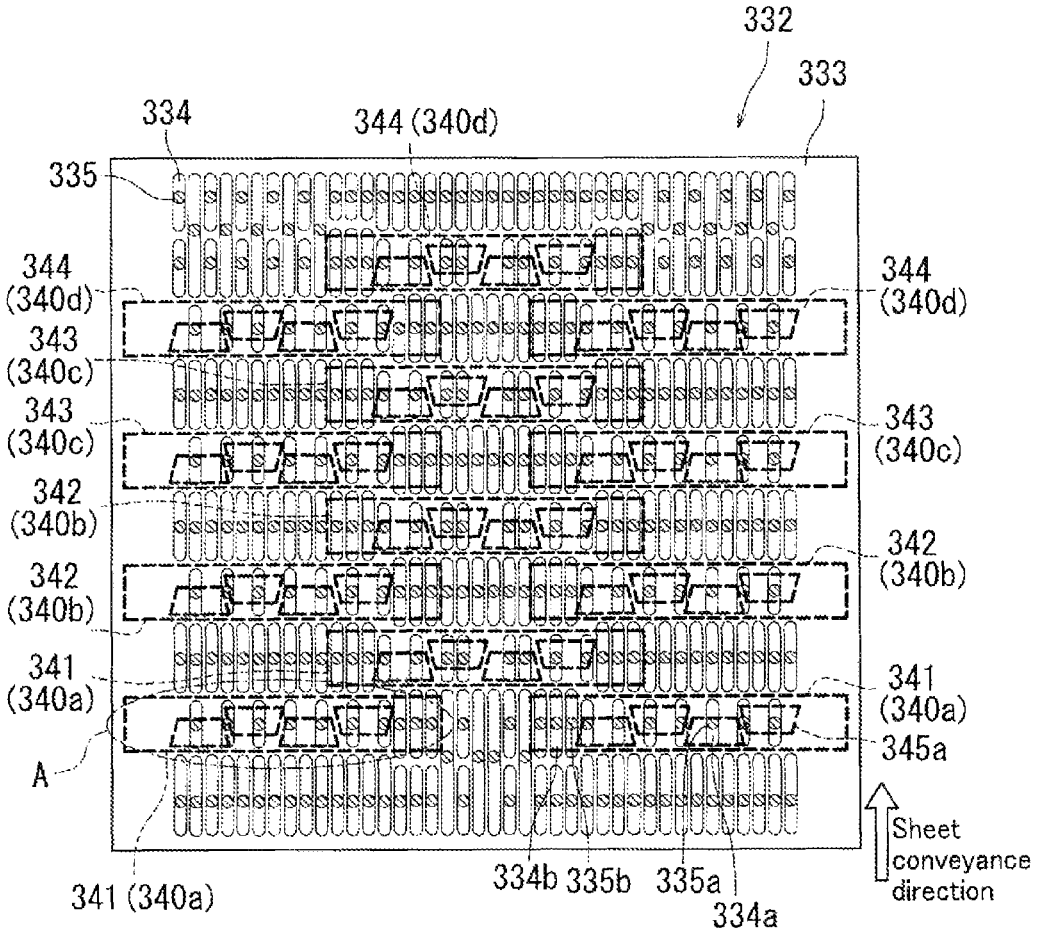
FIG. 2 is a plan view illustrating a guide member according to the first embodiment of the present disclosure.

FIG. 2 is a plan view of the guide member 332. FIG. 2 illustrates positional relationship of the guide member 332 and the four types of line head 340*a*, 340*b*, 340*c*, and 340*d*. Note that the conveyor belt 320 is not illustrated in FIG. 2 in order to facilitate understanding.

As illustrated in FIG. 2, the line head 340*a* for black (Bk) includes three recording heads 341. The three recording heads 341 are arranged in the width direction of the guide member 332 (i.e., the direction perpendicular to the sheet conveyance direction) in a staggered formation.

The line head 340*b* for cyan (C) includes three recording heads 342. The three recording heads 342 are arranged in the width direction of the guide member 332 in a staggered formation.

The line head 340*c* for magenta (M) includes three recording heads 343. The three recording heads 343 are arranged in the width direction of the guide member 332 in a staggered formation.

The line head 340*d* for yellow (Y) includes three recording heads 344. The three recording heads 344 are arranged in the width direction of the guide member 332 in a staggered formation.

Figure 3:
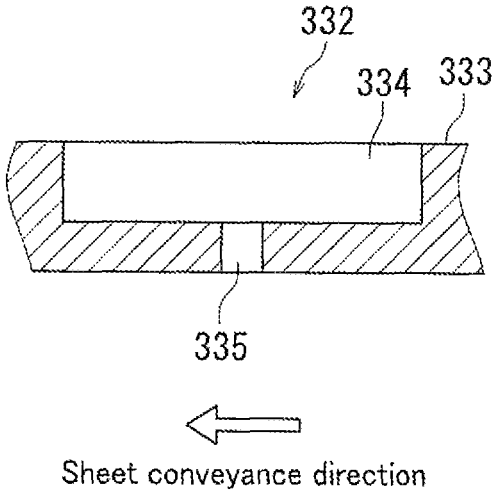
FIG. 3 is a cross-sectional view illustrating a groove and a through hole of the guide member according to the first embodiment of the present disclosure.

The guide member 332 has a plurality of grooves 334 into a surface 333 thereof on a side closest to the line heads 340*a*-340*d* (recording heads 341-344). The surface 333 faces toward the line heads 340*a*-340*d* (recording heads 341-344). The grooves 334 each have a rod-like shape with rounded ends that extends in the sheet conveyance direction. FIG. 3 is a cross-sectional view illustrating a groove 334 and a through hole 335 in the guide member 332. As illustrated in FIGS. 2 and 3, for each of the plurality of grooves 334, the guide member 332 has a corresponding through hole 335 that runs through the guide member 332 in a thickness direction thereof.

Figure 4:
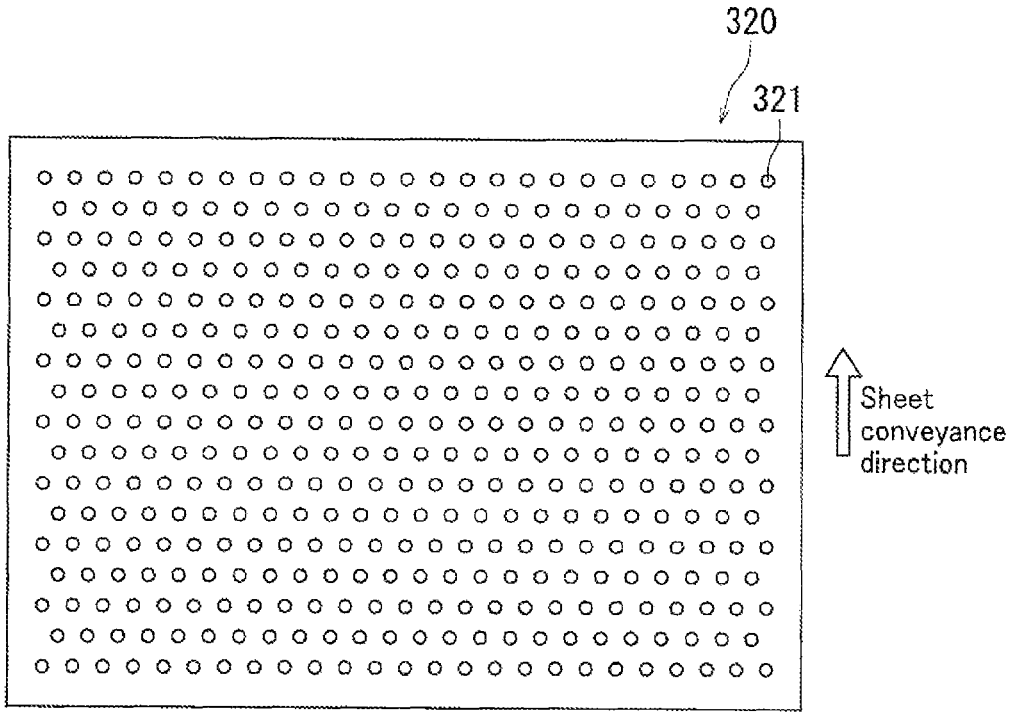
FIG. 4 is a plan view illustrating a conveyor belt according to the first embodiment of the present disclosure.

FIG. 4 is a plan view illustrating the conveyor belt 320. As illustrated in FIG. 4, the conveyor belt 320 has a plurality of suction holes 321 that are perforated through the conveyor belt 320. The suction holes 321 each have a diameter of, for example, 2 mm. The spacing between adjacent suction holes 321 is, for example, 8 mm.

A plurality of columns that each include a plurality of the suction holes 321 arranged in the sheet conveyance direction are arranged in the width direction of the conveyor belt 320 (i.e., the direction perpendicular to the sheet conveyance direction) such that the suction holes 321 are arranged in a staggered formation. On the other hand, in the guide member 332 a plurality of columns that each include a plurality of the grooves 334 arranged in the sheet conveyance direction are arranged in the width direction of the guide member 332 (i.e., the direction perpendicular to the sheet conveyance direction) as illustrated in FIG. 2. The columns of the suction holes 321 in the conveyor belt 320 are arranged such as to correspond to the columns of the grooves 334 in the guide member 332.

Each of the grooves 334 is located such as to be opposite to at least two of the suction holes 321. The suction holes 321 that are opposite to the groove 334 change one-by-one as the conveyor belt 320 circulates.

The air flow chamber 331 (refer to FIG. 1) is in communication with the suction holes 321 (refer to FIG. 4) in the conveyor belt 320 through the through holes 335 (refer to FIG. 2) and the grooves 334 (refer to FIG. 2) in the guide member 332.

[Operation of Inkjet Recording Apparatus 1]

The following explains operation of the inkjet recording apparatus 1 with reference to FIG. 1. A sheet P is picked up from the sheet feed cassette 201 by the sheet feed roller 202. The picked-up sheet P is guided to the first pair of conveyance rollers 402 by the guide plates 203. In a situation in which a plurality of sheets P are stacked in the sheet feed cassette 201, an uppermost sheet P in the stack is picked up from the sheet feed cassette 201 by the sheet feed roller 202.

The sheet P is fed into the sheet conveyance path 401 by the first pair of conveyance rollers 402 and is then conveyed in the sheet conveyance direction by the second pair of conveyance rollers 403. The sheet P stops upon coming into contact with the pair of registration rollers 404. Through the above, skew correction is performed on the sheet P. The sheet P is subsequently fed to the image forming section 300 in synchronization with timing of image formation.

The sheet P is guided and caused to be sucked onto the conveyor belt 320 by the sheet holding roller 312. Preferably the sheet P is guided onto the conveyor belt 320 such that the center of the sheet P in terms of the width direction thereof coincides with the center of the conveyor belt 320 in terms of the width direction thereof. The sheet P covers a portion of the suction holes 321 in the conveyor belt 320. The suction section 330 sucks air (an example of a gas) through the through holes 335 and the grooves 334 in the guide member 332 and the suction holes 321 in the conveyor belt 320. In other words, the suction section 330 creates negative pressure in the air flow chamber 331. The negative pressure acts on the sheet P, thereby sucking the sheet P onto the conveyor belt 320. The sheet P is conveyed in the sheet conveyance direction as the conveyor belt 320 circulates.

The conveyor belt 320 conveys each portion of the sheet P, in turn, to positions opposite to the four types of line head 340*a*, 340*b*, 340*c*, and 340*d* (recording heads 341-344). During the aforementioned conveyance, each of the four types of line head 340*a*, 340*b*, 340*c*, and 340*d* (recording heads 341-344) ejects ink droplets of the corresponding color toward the sheet P. Through the above process, an image is formed on the sheet P.

The sheet P is conveyed from the conveyor belt 320 to the conveyance guide 350. Once the sheet P has passed through the conveyance guide 350, the sheet P is fed toward the exit port 101 by the pair of ejection rollers 501 and is guided onto the exit tray 502. As a result, the sheet P is ejected externally from the housing 100 through the exit port 101.

In the line head inkjet recording apparatus 1 explained above, the line heads 340*a*, 340*b*, 340*c*, and 340*d* (recording heads 341-344) are fixed in place. The sheet P is conveyed under the line heads 340*a*, 340*b*, 340*c*, and 340*d* (recording heads 341-344). Therefore, the recording rate of the inkjet recording apparatus 1 can be increased by increasing the conveyance speed of the sheet P. For example, the conveyance speed of the sheet P in the inkjet recording apparatus 1 can be set at 900 mm/s. Also, in a situation in which A4 size paper P is conveyed with a long edge thereof orientated perpendicularly to the conveyance direction, the inkjet recording apparatus 1 can for example have a printing rate of 150 sheets per minute.

[Configuration of Guide Member 332]

Figure 5:
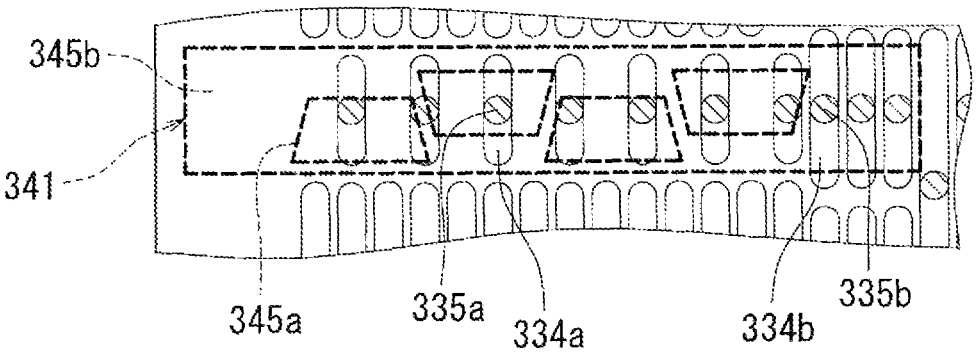
FIG. 5 is a plan view illustrating section A of FIG. 2.

FIG. 5 is a plan view illustrating section A of FIG. 2. In other words, FIG. 5 is an enlarged view of one section of the guide member 332. Note that the conveyor belt 320 is not illustrated in FIG. 5 in order to facilitate understanding.

As illustrated in FIGS. 2 and 5, a head surface of each of the recording heads 341, 342, 343, and 344 has ejection regions 345*a* and a non-ejection region 345*b*. The head surface is a belt facing surface that faces toward the conveyor belt 320. Nozzle orifices are present in the ejection regions 345*a*. The non-ejection region 345*b* is a region of the head surface that is exclusive of the ejection regions 345*a*. In other words, the non-ejection region 345*b* is a region of the head surface that is outside of the ejection regions 345*a*.

Figure 6:
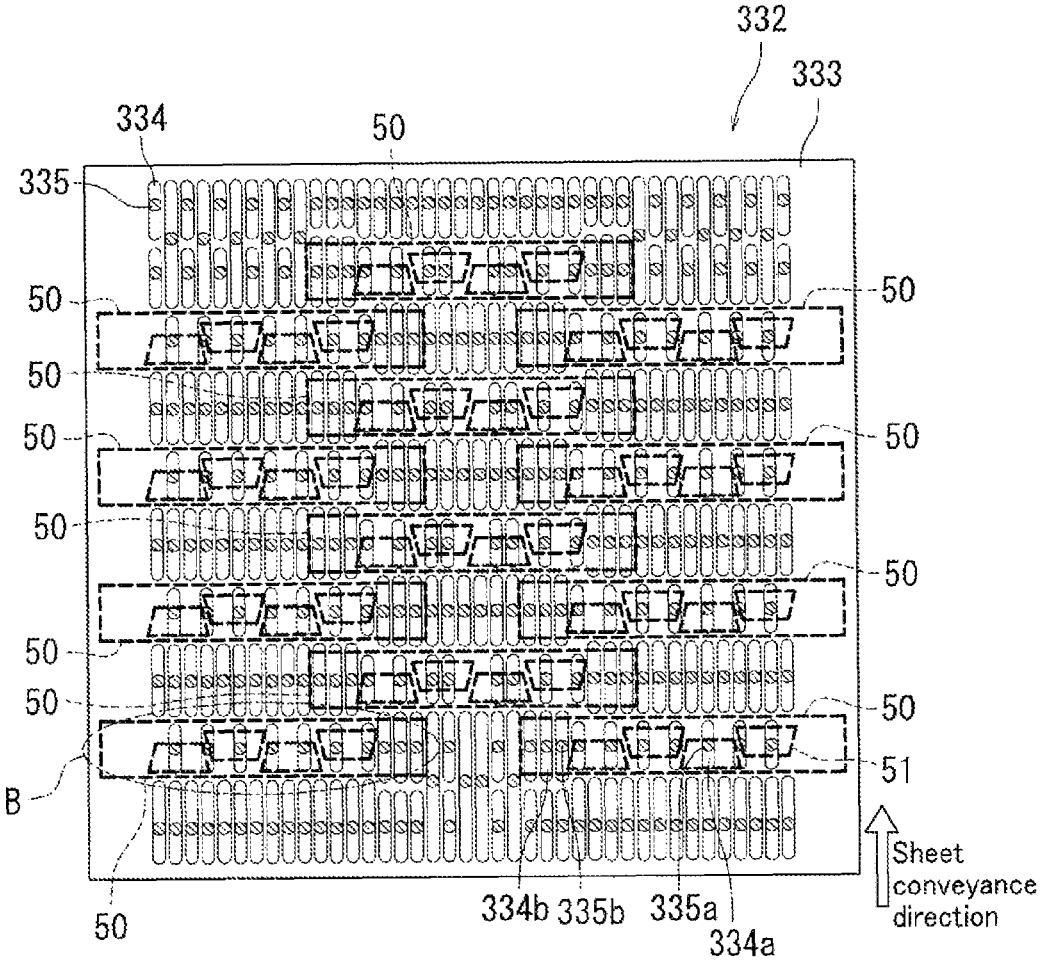
FIG. 6 is a plan view illustrating the guide member according to the first embodiment of the present disclosure.
Figure 7:
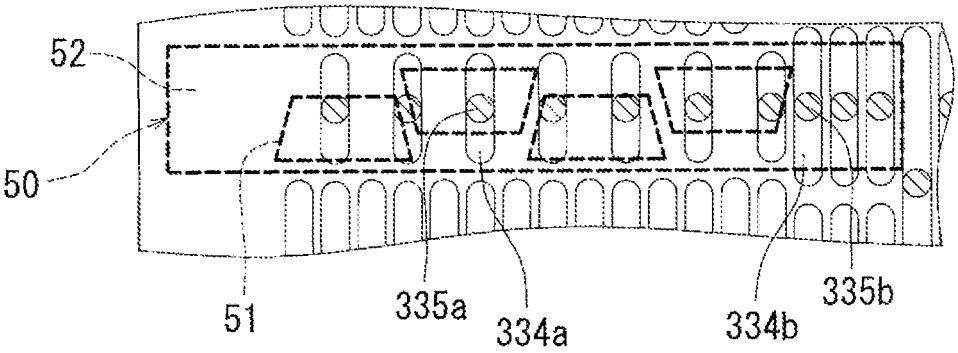
FIG. 7 is a plan view illustrating section B of FIG. 6.

FIG. 6 is a plan view illustrating the guide member 332. FIG. 7 is a plan view illustrating section B of FIG. 6. In other words, FIG. 7 is an enlarged view of one section of the guide member 332. As illustrated in FIGS. 6 and 7, the through holes 335 include first through holes 335*a* and second through holes 335*b*. The first through holes 335*a* are within first regions 51 of the guide member 332. The second through holes 335*b* are within second regions 52 of the guide member 332. The first regions 51 are located opposite to the ejection regions 345*a* explained with reference to FIGS. 2 and 5. The second regions 52 are located opposite to the non-ejection regions 345*b* explained with reference to FIGS. 2 and 5. The first regions 51 and the second regions 52 form head facing regions 50 that are located opposite to the recording heads 341, 342, 343, and 344 explained with reference to FIG. 2.

The grooves 334 into the surface 333 of the guide member 332 include first grooves 334*a* and second grooves 334*b*. The first through holes 335*a* are located inside of the first grooves 334*a*. The second through holes 335*b* are located inside of the second grooves 334*b*.

Therefore, according to the first embodiment, the first through holes 335*a* are located below the ejection regions 345*a* of the head surfaces (i.e., within the first regions 51) and the second through holes 335*b* are located below the non-ejection regions 345*b* of the head surfaces (i.e., within the second regions 52). The above configuration ensures that suction force acting on the sheet P below each of the recording heads 341, 342, 343, and 344 is not insufficient. Therefore, the above configuration restricts the sheet P from rising up off the conveyor belt 320. In a situation in which the sheet P rises up off the conveyor belt 320 under the recording heads 341, 342, 343, and 344, a distorted image may be formed on the sheet P. Also, a paper jam may occur under the recording heads 341, 342, 343, and 344. The first embodiment enables restriction of rising up of the sheet P and thus enables restriction of distortion of the image formed on the sheet P. Also, the first embodiment enables reduced probability of a paper jam occurring under the recording heads 341, 342, 343, and 344.

Furthermore, as illustrated in FIGS. 2 and 5-7, the first grooves 334*a* are shorter than the second grooves 334*b* in the first embodiment. As a result, regions below the ejection regions 345*a* of the recording heads 341-344 (i.e., the first regions 51) have greater pressure loss than regions below the non-ejection regions 345*b* of the recording heads 341-344 (i.e., the second regions 52).

Therefore, the first embodiment enables suction air flow created below the ejection regions 345*a* of the head surfaces to be made smaller than suction air flow created below the non-ejection regions 345*b* of the head surfaces. The aforementioned suction air flow is created by air being sucked toward the air flow chamber 331 through the grooves 334 and the through holes 335 in the guide member 332 and the suction holes 321 in the conveyor belt 320. The following explains the relationship between pressure loss and suction air flow using an example of suction air flow created under a recording head 341.

Figure 8A:
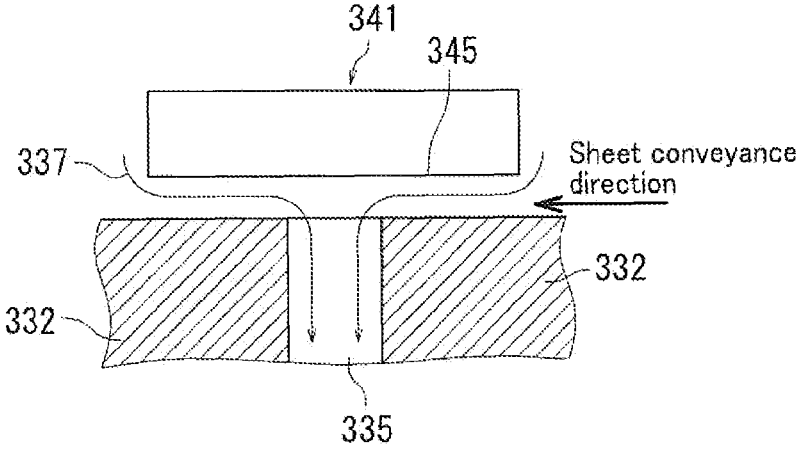
FIGS. 8A, 8B, and 8C are cross-sectional views illustrating the flow rate of suction air flow created under a recording head.
Figure 8B:
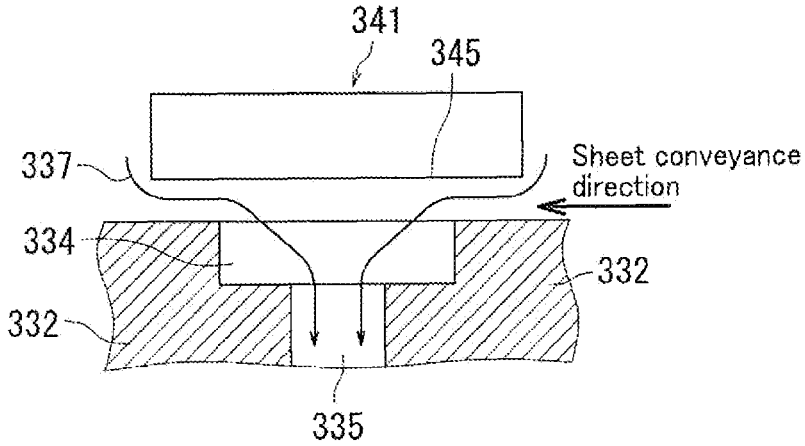
Figure 8C:
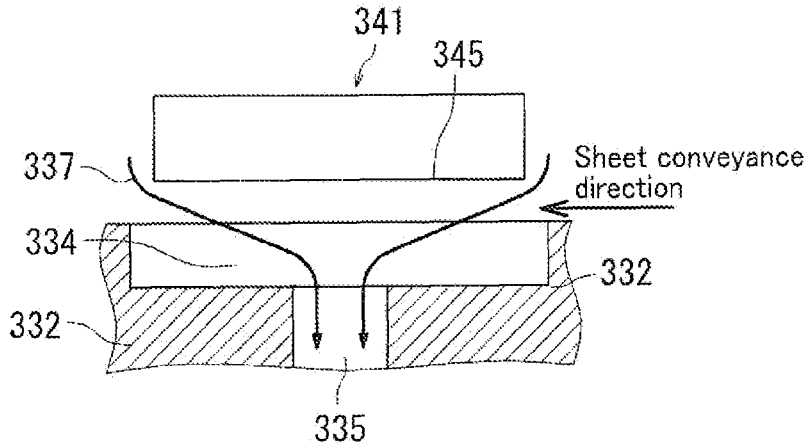

FIGS. 8A, 8B, and 8C are cross-sectional views illustrating the flow rate of suction air flow 337 created under the recording head 341. Specifically, FIG. 8A illustrates suction air flow 337 created in a configuration in which a through hole 335 is not located inside of a groove 334. FIG. 8B illustrates suction air flow 337 created in a configuration in which a groove 334 is located entirely within a region (head facing region 50) that is a projection of a head surface 345 (surface facing toward the guide member 332) of the recording head 341. FIG. 8C illustrates suction air flow 337 created in a configuration in which both ends of a groove 334 protrude outside of the region (head facing region 50) that is a projection of the head surface 345. Note that the conveyor belt 320 is not illustrated in FIGS. 8A, 8B, and 8C in order to facilitate understanding.

The thickness of arrows indicating suction air flow 337 in FIGS. 8A, 8B, and 8C represents the flow rate of suction air flow 337. In general, the head surface 345 and the guide member 332 are separated by approximately 0.5 mm to 3.0 mm and thus the gap between the head surface 345 and the guide member 332 is extremely narrow. As a consequence, the flow rate of suction air flow 337 is small due to extremely high pressure loss directly under the head surface 345. However, as illustrated in FIGS. 8B and 8C, pressure loss directly under the head surface 345 can be made smaller and the flow rate of suction air flow 337 can be made larger by providing a groove 334 directly under the head surface 345. Therefore, the flow rate of suction air flow 337 is smallest in a configuration in which no groove 334 is present (FIG. 8A). The area of an aperture of the groove 334 is made larger and pressure loss directly under the head surface 345 is made smaller by making the length of the groove 334 longer. Therefore, the flow rate of suction air flow 337 is greater in a configuration in which the groove 334 is longer (FIGS. 8B and 8C).

When a sheet P having paper dust attached thereto is conveyed to a position where the guide member 332 and the recording head 341 are directly opposite to one another, suction air flow 337 (air current) may cause the paper dust to be stirred up from the sheet P and become attached to a nozzle orifice (not illustrated) in the head surface 345. As a consequence, the nozzle orifice may unfortunately become clogged by the attached paper dust.

In the first embodiment, the first through holes 335*a* are located opposite to the ejection regions 345*a* of the head surfaces and the second through holes 335*b* are located opposite to the non-ejection regions 345*b* of the head surfaces, as illustrated in FIGS. 2 and 5. Also, the first through holes 335*a* are located inside of the first grooves 334*a* and the second through holes 335*b* are located inside of the second grooves 334*b*. The first grooves 334*a* are shorter than the second grooves 334*b*.

Figure 9A:
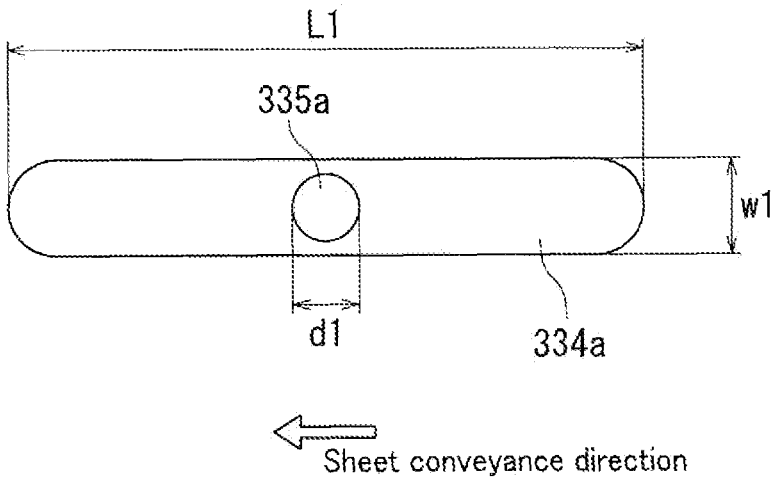
FIG. 9A is a plan view illustrating a first groove according to the first embodiment of the present disclosure and FIG. 9B is a plan view illustrating a second groove according to the first embodiment of the present disclosure.
Figure 9B:
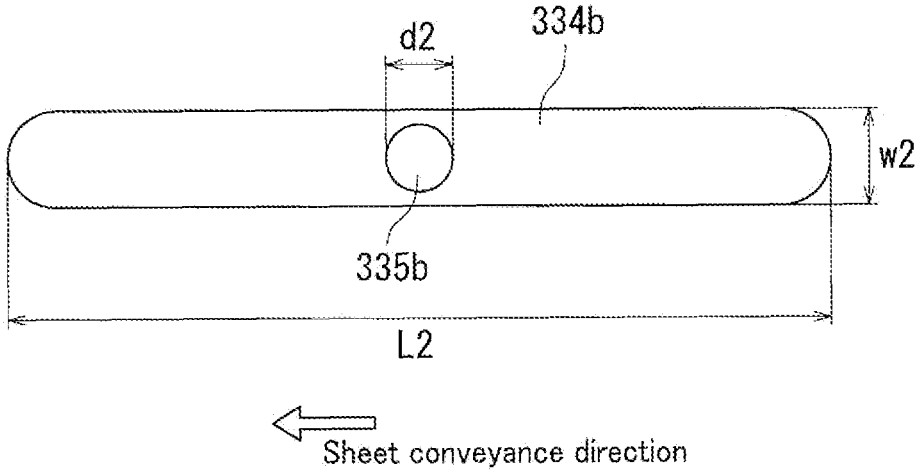

FIG. 9A is a plan view illustrating one of the first grooves 334*a* and FIG. 9B is a plan view illustrating one of the second grooves 334*b*. As illustrated in FIGS. 9A and 9B, the length L1 of the first grooves 334*a* is shorter than the length L2 of the second grooves 334*b* in the first embodiment. On the other hand, the width w1 of the first grooves 334*a* is the same as the width w2 of the second grooves 334*b*. Consequently, the first grooves 334*a* have a smaller aperture area than the second grooves 334*b*. Although not illustrated in FIGS. 9A and 9B, the first grooves 334*a* have the same depth as the second grooves 334*b*. The first through holes 335*a* and the second through holes 335*b* each have a circular cross-section and the diameter d1 of the first through holes 335*a* is the same as the diameter d2 of the second through holes 335*b*. Although not illustrated in FIGS. 9A and 9B, the first through holes 335*a* have the same depth as the second through holes 335*b*.

Therefore, as explained with reference to FIGS. 8B and 8C, regions below the ejection regions 345*a* of the head surfaces (i.e., the first regions 51) have a greater pressure loss than regions below the non-ejection regions 345*b* of the head surfaces (i.e., the second regions 52). Through the above, suction air flow created under the ejection regions 345*a* can be made smaller than suction air flow created under the non-ejection regions 345*b*.

As a result, even when a sheet P having paper dust attached thereto is conveyed by the conveyor device 310, stirring up of the paper dust can be restricted under the ejection regions 345*a* of the head surfaces and thus attachment of the paper dust to the nozzle orifices can be restricted. By restricting attachment of paper dust to the nozzle orifices, the probability of nozzle clogging occurring can be reduced. In particular, in the first embodiment the length in the sheet conveyance direction of each of the first grooves 334*a* is shorter than the length (width) in the sheet conveyance direction of the head surface of a corresponding one of the recording heads 341, 342, 343, or 344 opposite thereto as illustrated in FIGS. 2 and 5. As explained with reference to FIGS. 8B and 8C, the configuration described above effectively restricts the flow rate of suction air flow.

As a result of the second grooves 334*b* being longer than the first grooves 334*a*, the flow rate of suction air flow created under the non-ejection regions 345*b* of the head surfaces is larger than the flow rate of suction air flow created under the ejection regions 345*a* of the head surfaces. Therefore, suction force acting on the sheet P under the non-ejection regions 345*b* of the head surfaces is larger than suction force acting on the sheet P under the ejection regions 345*a* of the head surfaces. The configuration described above effectively restricts attachment of paper dust to the nozzle orifices while also effectively restricting rising up of the sheet P. In particular note that in the first embodiment, the length in the sheet conveyance direction of each of the second grooves 334*b* is longer than the length (width) in the sheet conveyance direction of the head surface of the corresponding one of the recording heads 341, 342, 343, or 344 opposite thereto. As explained with reference to FIGS. 8B and 8C, the configuration described above makes the flow rate of suction air flow larger and thus effectively restricts rising up of the sheet P.

In the first embodiment, the second grooves 334*b* have a greater density than the first grooves 334*a* as illustrated in FIGS. 2 and 6. As a result of the above configuration, the flow rate of suction air flow created under the non-ejection regions 345*b* of the head surfaces is larger than the flow rate of suction air flow created under the ejection regions 345*a* of the head surfaces. Therefore, the above configuration effectively restricts rising up of the sheet P. On the other hand, as a result of suction air flow created under the ejection regions 345*a* of the head surfaces being smaller than suction air flow created under the non-ejection regions 345*b* of the head surfaces, the above configuration can also restrict attachment of paper dust to the nozzle orifices.

The second through holes 335*b* have a greater density than the first through holes 335*a* in the first embodiment. As a result of the above configuration, the flow rate of suction air flow created under the non-ejection regions 345*b* of the head surfaces is larger than the flow rate of suction air flow created under the ejection regions 345*a* of the head surfaces. Therefore, the above configuration effectively restricts rising up of the sheet P. On the other hand, as a result of suction air flow created under the ejection regions 345*a* of the head surfaces being smaller than suction air flow created under the non-ejection regions 345*b* of the head surfaces, the above configuration can also restrict attachment of paper dust to the nozzle orifices.

Figure 10:
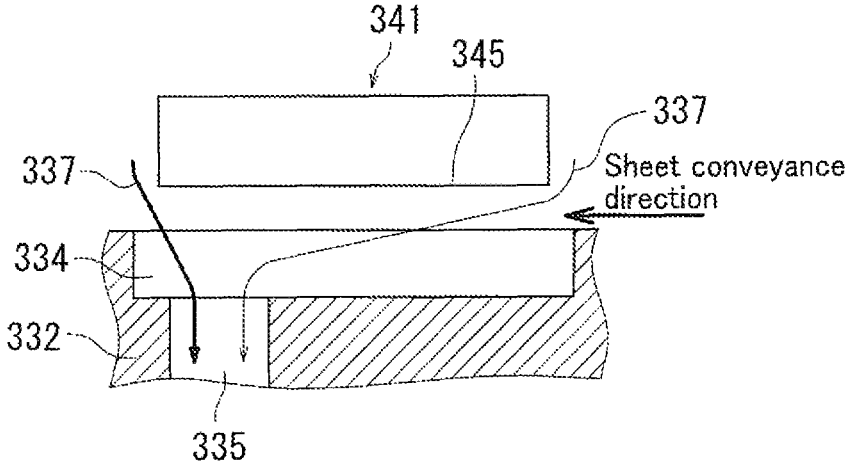
FIG. 10 is a cross-sectional view illustrating the flow rate of suction air flow created under a recording head.

In the first embodiment, the second through holes 335*b* are located centrally in the second grooves 334*b* in terms of the sheet conveyance direction. FIG. 10 is a cross-sectional view illustrating the flow rate of suction air flow 337 created under a recording head 341. More specifically, FIG. 10 illustrates suction air flow 337 that is created in a configuration in which the position of a through hole 335 is shifted downstream in the sheet conveyance direction relative to the center of a head surface 345. Note that the conveyor belt 320 is not illustrated in FIG. 10 in order to facilitate understanding.

The thickness of arrows indicating suction air flow 337 in FIG. 10 represents the flow rate of suction air flow 337. As illustrated in FIG. 10, in a configuration in which the position of the through hole 335 is shifted downstream in the sheet conveyance direction relative to the center of the head surface 345, suction air flow 337 under the head surface 345 from a downstream side of the head surface 345 in terms of the sheet conveyance direction is large. On the other hand, suction air flow 337 under the head surface 345 from an upstream side of the head surface 345 in terms of the sheet conveyance direction is small. As a result, suction force acting on the sheet P has an uneven distribution. In consideration of the above, in the first embodiment the second through holes 335*b* are located centrally in the second grooves 334*b* in terms of the sheet conveyance direction. Therefore, unevenness in the distribution of suction force can be restricted, thereby effectively restricting rising up of the sheet P.

The cross-sectional area of the grooves 334 also influences pressure loss. For example, in a configuration in which the second grooves 334*b* are wider than the first grooves 334*a*, regions opposite to the non-ejection regions 345*b* of the head surfaces (i.e., the second regions 52) have a smaller pressure loss than regions opposite to the ejection regions 345*a* of the head surfaces (i.e., the first regions 51). As a result, suction air flow created in the second regions 52 is larger than suction air flow created in the first regions 51. Therefore, such a configuration effectively restricts rising up of the sheet P. The second regions 52 also have a smaller pressure loss than the first regions 51 in a configuration in which the second grooves 334*b* are deeper than the first grooves 334*a*. Therefore, such a configuration effectively restricts rising up of the sheet P.

Figure 11A:
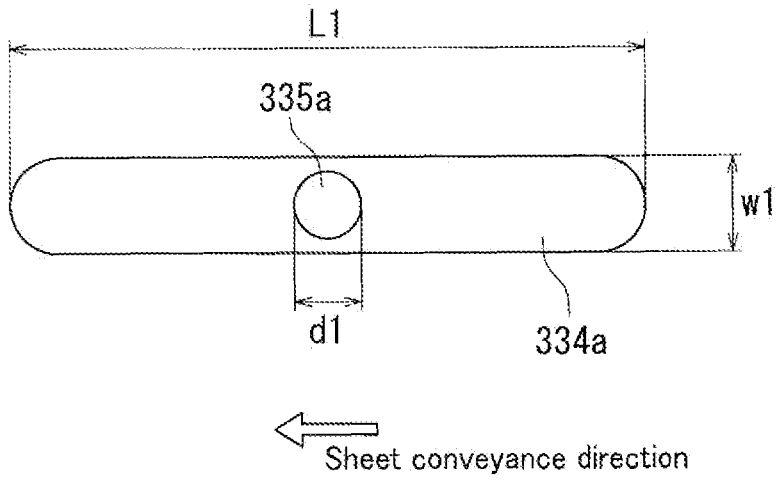
FIG. 11A is a plan view illustrating a first alternative example of the first groove according to the first embodiment of the present disclosure and FIG. 11B is a plan view illustrating a first alternative example of the second groove according to the first embodiment of the present disclosure.
Figure 11B:
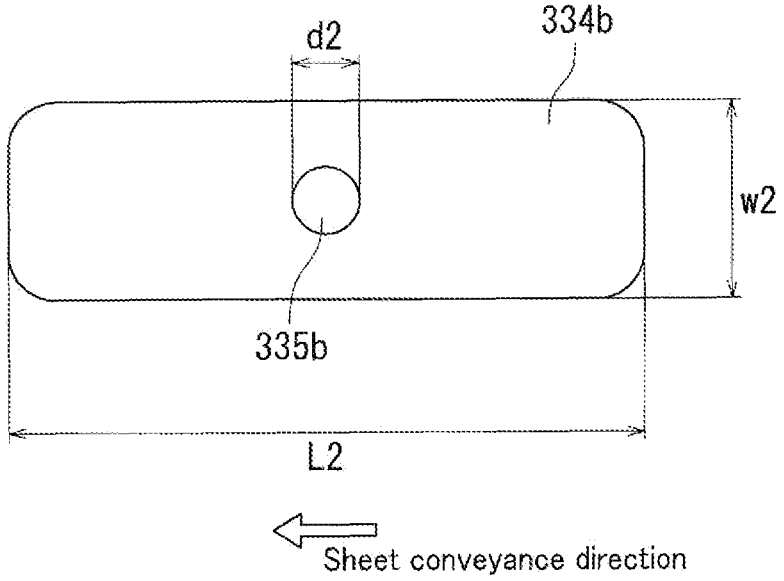

FIG. 11A is a plan view illustrating a first alternative example of the first grooves 334*a* and FIG. 11B is a plan view illustrating a first alternative example of the second grooves 334*b*. As illustrated in FIGS. 11A and 11B, the length L2 of the second grooves 334*b* is the same as the length L1 of the first grooves 334*a*. On the other hand, the width w2 of the second grooves 334*b* is greater than the width w1 of the first grooves 334*a*. Although not illustrated in FIGS. 11A and 11B, the second grooves 334*b* have the same depth as the first grooves 334*a*. Therefore, the second grooves 334*b* have a larger cross-sectional area than the first grooves 334*a*. The first through holes 335*a* and the second through holes 335*b* each have a circular cross-section and the diameter d1 of the first through holes 335*a* is the same as the diameter d2 of the second through holes 335*b*. Although not illustrated in FIGS. 11A and 11B, the first through holes 335*a* have the same depth as the second through holes 335*b*.

Through the above configuration, regions opposite to the non-ejection regions 345*b* of the head surfaces (i.e., the second regions 52) have a smaller pressure loss than regions opposite to the ejection regions 345*a* of the head surfaces (i.e., the first regions 51). As a result, suction air flow created in the second regions 52 is larger than suction air flow created in the first regions 51. Therefore, the above configuration effectively restricts rising up of the sheet P. Also, as a result of suction air flow created under the ejection regions 345*a* of the head surfaces being smaller than suction air flow created under the non-ejection regions 345*b* of the head surfaces, the above configuration also restricts attachment of paper dust to the nozzle orifices.

Figure 12A:
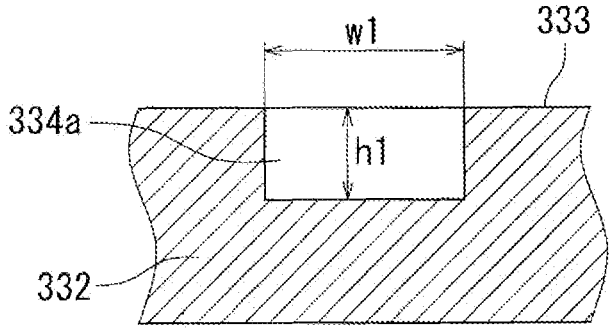
FIG. 12A is a cross-sectional view illustrating a second alternative example of the first groove according to the first embodiment of the present disclosure and FIG. 12B is a cross-sectional view illustrating a second alternative example of the second groove according to the first embodiment of the present disclosure.
Figure 12B:
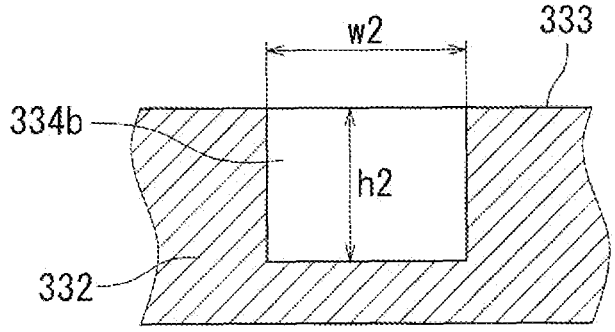

FIG. 12A is a cross-sectional view illustrating a second alternative example of the first grooves 334*a*. More specifically, FIG. 12A illustrates the second alternative example of the first grooves 334*a* as viewed in the sheet conveyance direction. FIG. 12B is a cross-sectional view illustrating a second alternative example of the second grooves 334*b*. More specifically, FIG. 12B illustrates the second alternative example of the second grooves 334*b* as viewed in the sheet conveyance direction. As illustrated in FIGS. 12A and 12B, the height (depth) h2 of the second grooves 334*b* is greater (deeper) than the height (depth) h1 of the first grooves 334*a*. On the other hand, the width w2 of the second grooves 334*b* is the same as the width w1 of the first grooves 334*a*. Therefore, the second grooves 334*b* have a greater cross-sectional area than the first grooves 334*a*. Although not illustrated in FIGS. 12A and 12B, the second grooves 334*b* have the same length as the first grooves 334*a*. Also, although not illustrated in FIGS. 12A and 12B, the first through holes 335*a* and the second through holes 335*b* each have a circular cross-section and the first through holes 335*a* have the same depth and diameter as the second through holes 335*b*.

Through the above configuration, the regions opposite to the non-ejection regions 345*b* of the head surfaces (i.e., the second regions 52) have a smaller pressure loss than the regions opposite to the ejection regions 345*a* of the head surfaces (i.e., the first regions 51). As a result, suction air flow created in the second regions 52 is larger than suction air flow created in the first regions 51. Therefore, the above configuration restricts rising up of the paper P. Also, as a result of suction air flow created under the ejection regions 345*a* of the head surfaces being smaller than suction air flow created under the non-ejection regions 345*b* of the head surfaces, the above configuration also restricts attachment of paper dust to the nozzle orifices.

Figure 13A:
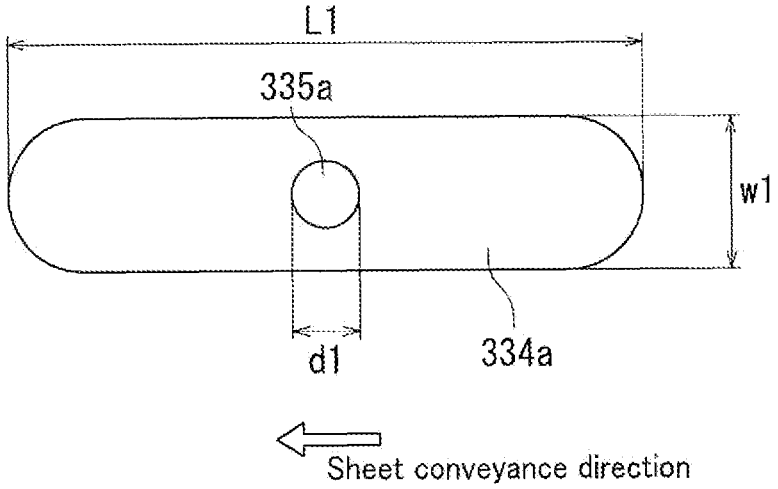
FIG. 13A is a plan view illustrating a first alternative example of a first through hole according to the first embodiment of the present disclosure and FIG. 13B is a plan view illustrating a first alternative example of a second through hole according to the first embodiment of the present disclosure.
Figure 13B:
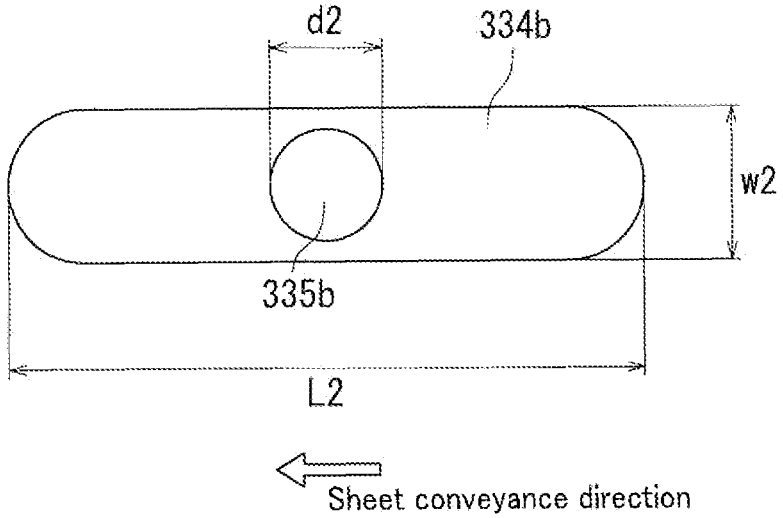

Pressure loss is influenced not only by the grooves 334, but also by the cross-sectional area and the depth of the through holes 335. FIG. 13A is a plan view illustrating a first alternative example of the first through holes 335*a* and FIG. 13B is a plan view illustrating a first alternative example of the second through holes 335*b*. As illustrated in FIGS. 13A and 13B, the first through holes 335*a* and the second through holes 335*b* each have a circular cross-section and the diameter d2 of the second through holes 335*b* is greater than the diameter d1 of the first through holes 335*a*. Therefore, the second through holes 335*b* have a greater cross-sectional area than the first through holes 335*a*. On the other hand, although not illustrated in FIGS. 13A and 13B, the second through holes 335*b* have the same depth as the first through holes 335*a*. Also, the width w1 and the length L1 of the first grooves 334*a* are the same as the width w2 and the length L2 of the second grooves 334*b*. Although not illustrated in FIGS. 13A and 13B, the first grooves 334*a* have the same depth as the second grooves 334*b*.

Through the above configuration, the regions opposite to the non-ejection regions 345*b* of the head surfaces (i.e., the second regions 52) have a smaller pressure loss than the regions opposite to the ejection regions 345*a* of the head surfaces (i.e., the first regions 51). As a result, suction air flow created in the second regions 52 is larger than suction air flow created in the first regions 51. Therefore, the above configuration restricts rising up of the paper P. Also, as a result of suction air flow created under the ejection regions 345*a* of the head surfaces being smaller than suction air flow created under the non-ejection regions 345*b* of the head surfaces, the above configuration also restricts attachment of paper dust to the nozzle orifices.

Figure 14A:
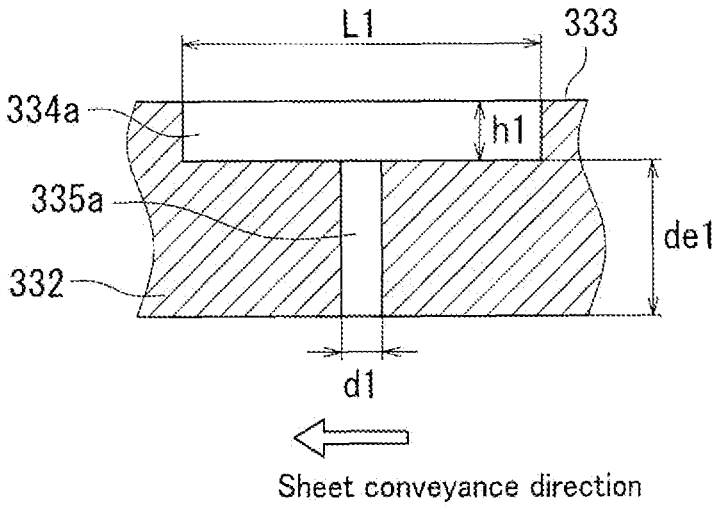
FIG. 14A is a cross-sectional view illustrating a second alternative example of the first through hole according to the first embodiment of the present disclosure and FIG. 14B is a cross-sectional view illustrating a second alternative example of the second through hole according to the first embodiment of the present disclosure.
Figure 14B:
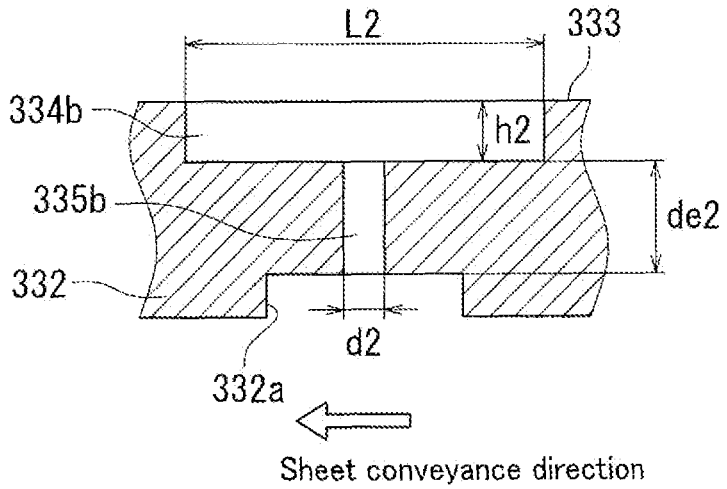

FIG. 14A is a cross-sectional view illustrating a second alternative example of the first through holes 335*a* and FIG. 14B is a cross-sectional view illustrating a second alternative example of the second through holes 335*b*. The first through holes 335*a* and the second through holes 335*b* each have a circular cross-section. As illustrated in FIGS. 14A and 14B, the depth de2 of the second through holes 335*b* is smaller than the depth de1 of the first through holes 335*a*. On the other hand, the diameter d2 of the second through holes 335*b* is the same as the diameter d1 of the first through holes 335*a*. Also, the height h1 and the length L1 of the first grooves 334*a* are the same as the height h2 and the length L2 of the second grooves 334*b*. Although not illustrated in FIGS. 14A and 14B, the first grooves 334*a* have the same width as the second grooves 334*b*.

Through the above configuration, the regions opposite to the non-ejection regions 345*b* of the head surfaces (i.e., the second regions 52) have a smaller pressure loss than the regions opposite to the ejection regions 345*a* of the head surfaces (i.e., the first regions 51). As a result, suction air flow created in the second regions 52 is larger than suction air flow created in the first regions 51. Therefore, the above configuration restricts rising up of the paper P. Also, as a result of suction air flow created under the ejection regions 345*a* of the head surfaces being smaller than suction air flow created under the non-ejection regions 345*b* of the head surfaces, the above configuration also restricts attachment of paper dust to the nozzle orifices.

Figure 15A:
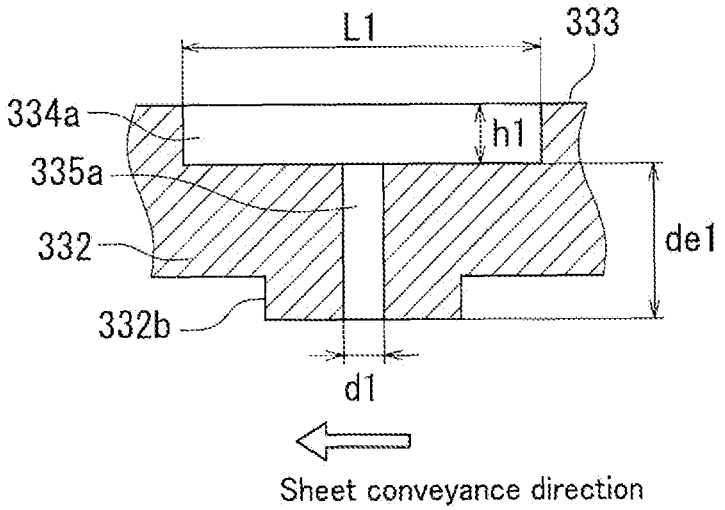
FIGS. 15A and 15B are cross-sectional views illustrating a variation of the guide member according to the first embodiment of the present disclosure.
Figure 15B:
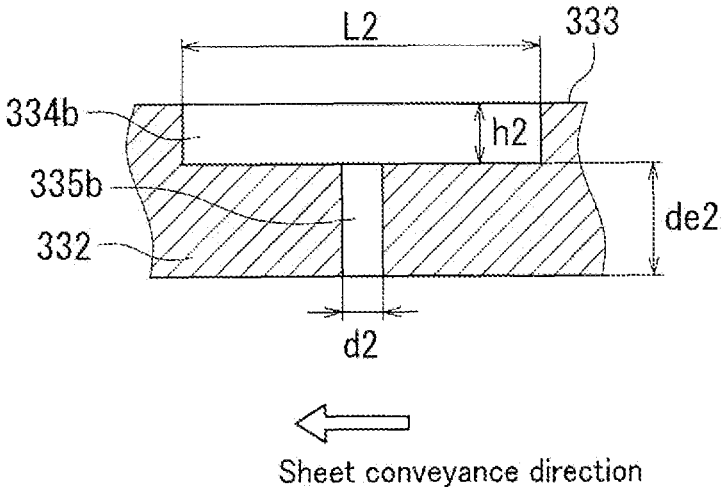

As illustrated in FIGS. 14A and 14B, the second alternative example of the first through holes 335*a* and the second alternative example of the second through holes 335*b* may be implemented by providing recesses 332*a* on the rear surface of the guide member 332, which is on an opposite side of the guide member 332 to the surface 333, at locations corresponding to the second through holes 335*b*. In other words, the second alternative example of the first through holes 335*a* and the second alternative example of the second through holes 335*b* can be implemented by making the guide member 332 narrower at the locations corresponding to the second through holes 335*b* than the guide member 332 at locations corresponding to the first through holes 335*a*. Further alternatively, protrusions 332*b* may be provided on the rear surface of the guide member 332 at the locations corresponding to the first through holes 335*a* as illustrated in FIGS. 15A and 15B. In other words, the guide member 332 may be made thicker at the locations corresponding to the first through holes 335*a* than the guide member 332 at the locations corresponding to the second through holes 335*b*.

Second Embodiment

Figure 16:
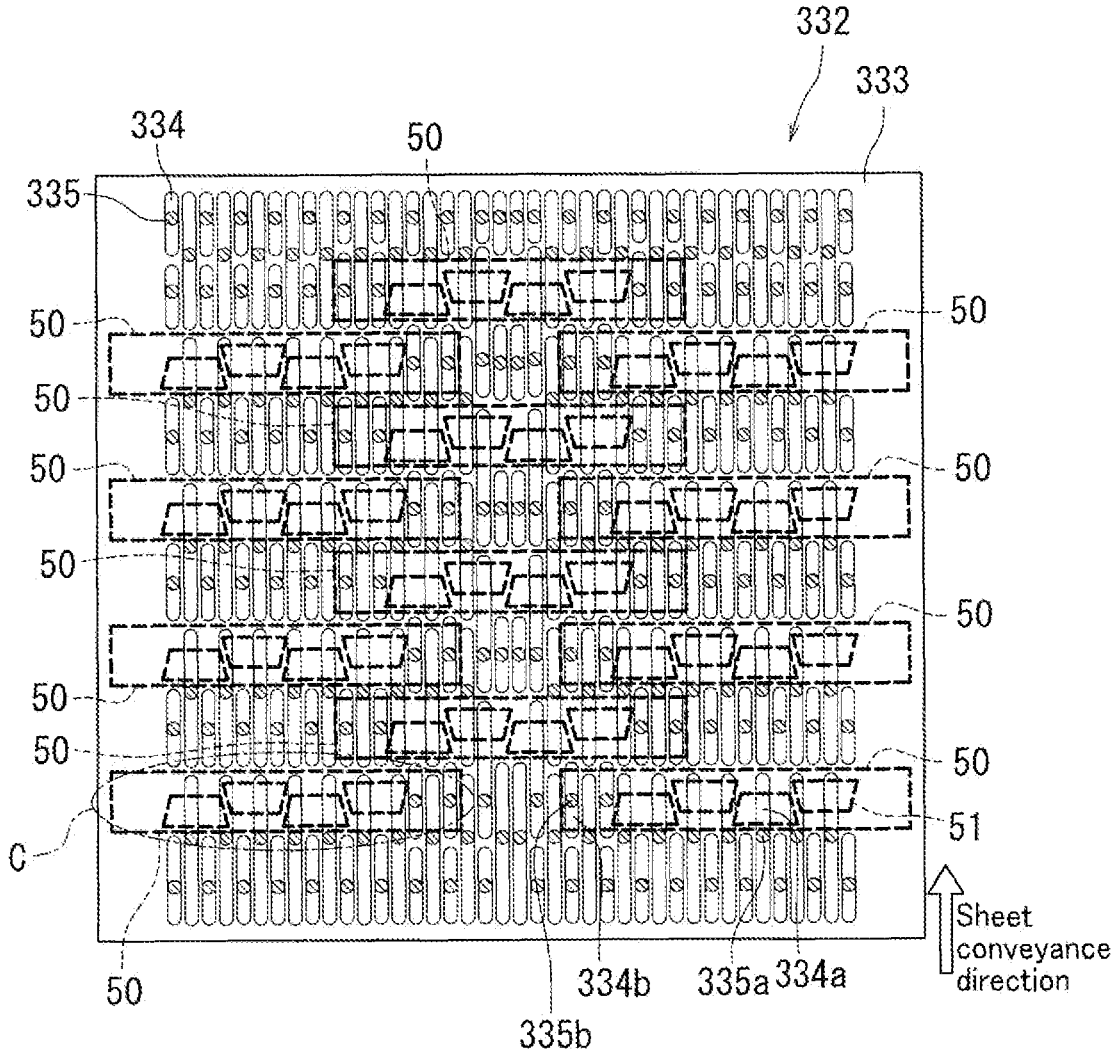
FIG. 16 is a plan view illustrating a guide member according to a second embodiment of the present disclosure.
Figure 17:
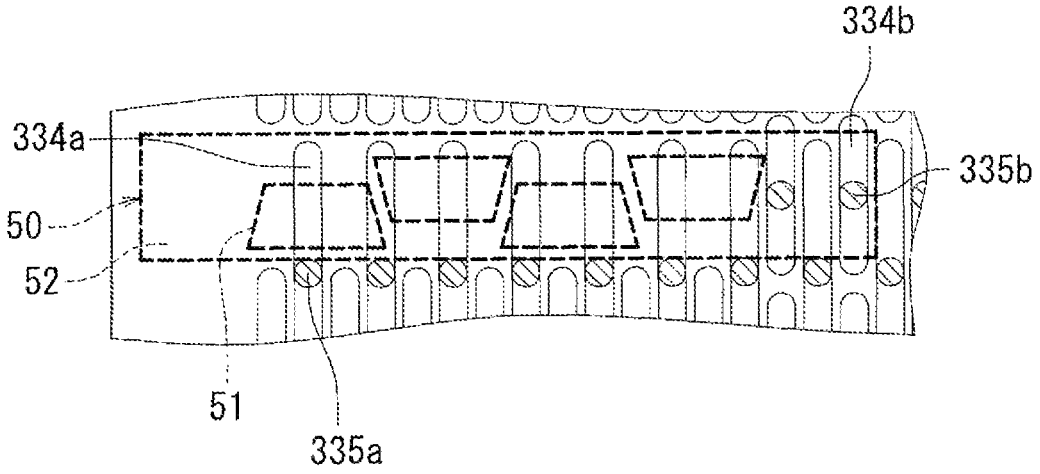
FIG. 17 is a plan view illustrating section C of FIG. 16.

The following explains a second embodiment of the present disclosure. FIG. 16 is a plan view illustrating a guide member 332 according to the second embodiment of the present disclosure. FIG. 17 is a plan view illustrating section C of FIG. 16. In other words, FIG. 17 is an enlarged view of one section of the guide member 332 according to the second embodiment. The second embodiment only differs from the first embodiment in terms of configuration of the guide member 332. The following explains the second embodiment based on differences compared to the first embodiment and omits explanation of matter that is the same as for the first embodiment.

Figure 18:
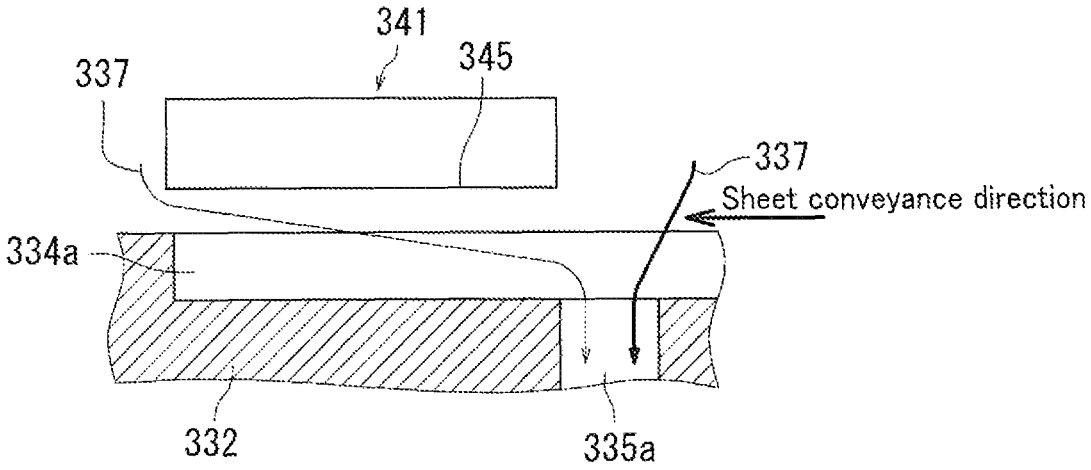
FIG. 18 is a cross-sectional view illustrating the flow rate of suction air flow created under a recording head according to the second embodiment of the present disclosure.

In the second embodiment, the first through holes 335*a* are located outside of the head facing regions 50 (i.e., outside of regions located opposite to the head surfaces of the recording heads 341, 342, 343, and 344). Therefore, all through holes 335 are located outside of the first regions 51 (i.e., outside of regions under the ejection regions 345*a* of the head surfaces of the recording heads 341, 342, 343, and 344). Also, in the second embodiment, each of the first grooves 334*a* includes a section outside of the head facing regions 50 and a section within one of the first regions 51 (i.e., within a region under an ejection region 345*a* of the corresponding head surface). FIG. 18 is a cross-sectional view illustrating the flow rate of suction air flow 337 created under a recording head 341. More specifically, FIG. 18 illustrates suction air flow 337 in a configuration in which a first through hole 335*a* is located upstream in terms of the sheet conveyance direction of a head facing region 50 opposite to a head surface 345. In other words, the first through hole 335*a* is located outside of the head facing region 50. Note that the conveyor belt 320 is not illustrated in FIG. 18 in order to facilitate understanding.

The thickness of arrows indicating suction air flow 337 in FIG. 18 represents the flow rate of suction air flow 337. In the configuration illustrated in FIG. 18, the first through hole 335*a* is located outside of the head facing region 50 opposite to the head surface 345, and a first groove 334*a* includes a section that is located outside of the head facing region 50 and a section that is located below the head surface 345 (i.e., within the head facing region 50). Such a configuration makes suction air flow 337 under the head surface 345 smaller. Therefore, the second embodiment restricts the flow rate of suction air flow (i.e., makes suction air flow smaller) that is created in the first regions 51 (i.e., under the ejection regions 345*a* of the head surfaces).

As a result, even when a sheet P having paper dust attached thereto is conveyed by the conveyor device 310, stirring up of the paper dust can be restricted in the first regions 51 (i.e., under the ejection regions 345*a* of the head surfaces) and thus attachment of the paper dust to nozzle orifices can be restricted. By restricting attachment of paper dust to the nozzle orifices, the probability of nozzle clogging occurring can be reduced. Note that attachment of paper dust to the nozzle orifices can be restricted in the same way in a configuration in which each of the first through holes 335*a* is located downstream in terms of the sheet conveyance direction relative to the head facing region 50 (i.e., the region located opposite to the corresponding head surface), and thus is located outside of the head facing region 50.

As illustrated in FIGS. 16 and 17, in the second embodiment the first grooves 334*a* are present in the first regions 51 (i.e., under the ejection regions 345*a* of the head surfaces) and the second through holes 335*b* and the second grooves 334*b* are present in the second regions 52 (i.e., under the non-ejection regions 345*b* of the head surfaces). The above configuration ensures that suction force acting on the sheet P below each of the recording heads 341, 342, 343, and 344 is not insufficient.

Note that in the same way as explained for the first embodiment, the second through holes 335*b* may have a greater density than the first through holes 335*a*. Also, the second through holes 335*b* may have a greater cross-sectional area than the first through holes 335*a*. Also, the second through holes 335*b* may be shallower than the first through holes 335*a*. Furthermore, the first through holes 335*a* and the second through holes 335*b* may exhibit any combination of the aforementioned features.

Also, as explained for the first embodiment, the length of the second grooves 334*b* in the sheet conveyance direction may be greater than the length (width) of the head facing regions 50 (head surfaces) in the sheet conveyance direction. Also, the second grooves 334*b* may have a greater cross-sectional area than the first grooves 334*a*. Also, the second grooves 334*b* may have a greater aperture area than the first grooves 334*a*. Also, the second grooves 334*b* may have a greater density than the first grooves 334*a*. Furthermore, the first grooves 334*a* and the second grooves 334*b* may exhibit any combination of the aforementioned features.

Third Embodiment

Figure 19:
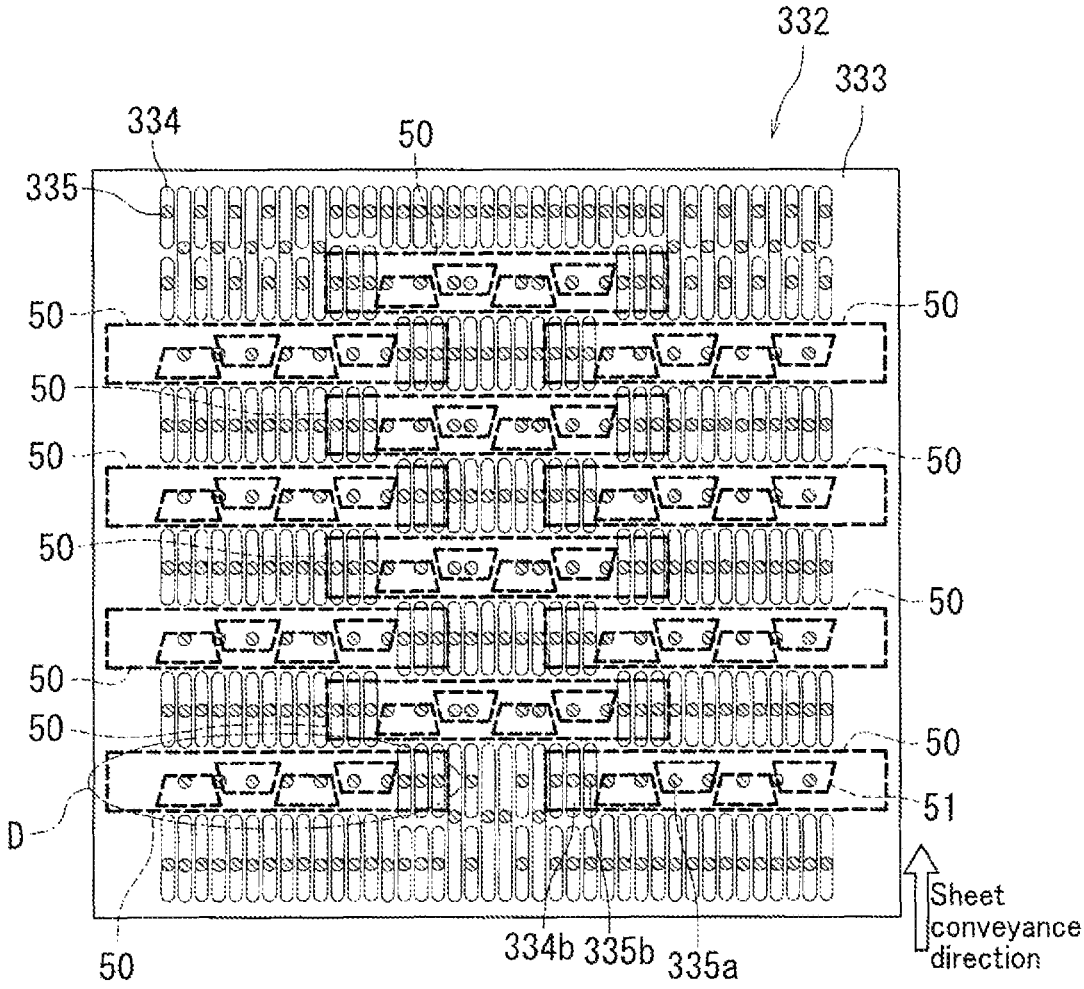
FIG. 19 is a plan view illustrating a guide member according to a third embodiment of the present disclosure.
Figure 20:
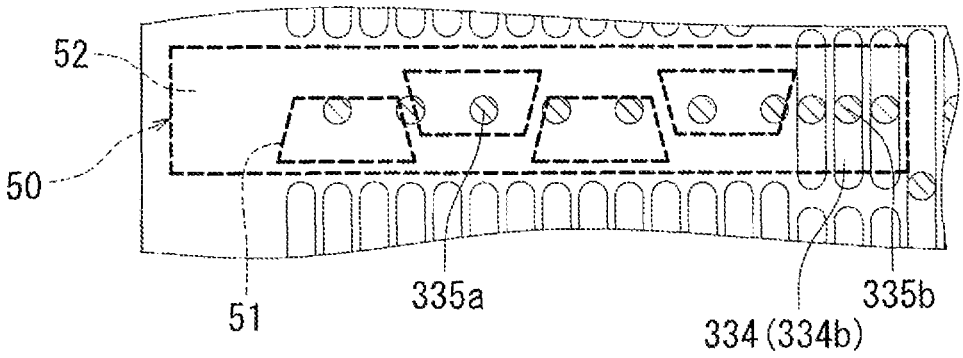
FIG. 20 is a plan view illustrating section D of FIG. 19.

The following explains a third embodiment of the present disclosure. FIG. 19 is a plan view illustrating a guide member 332 according to the third embodiment of the present disclosure. FIG. 20 is a plan view illustrating section D of FIG. 19. In other words, FIG. 20 is an enlarged view of one section of the guide member 332 according to the third embodiment. The third embodiment only differs from the first embodiment in terms of configuration of the guide member 332. The following explains the third embodiment based on differences compared to the first embodiment. Explanation is omitted for matter that is the same as for the first and second embodiments.

In the third embodiment, the first through holes 335*a* are not located inside of grooves 334 and are hence located outside of the grooves 334. As explained with reference to FIGS. 8A, 8B, and 8C, the flow rate of suction air flow 337 is smallest in a configuration in which no groove 334 is present.

Therefore, the third embodiment restricts the flow rate of suction air flow (i.e., makes suction air flow smaller) that is created in the first regions 51 (i.e., under the ejection regions 345*a* of the head surfaces). As a result, even when a sheet P having paper dust attached thereto is conveyed by the conveyor device 310, stiffing up of the paper dust can be restricted and thus attachment of the paper dust to nozzle orifices can be restricted. By restricting attachment of paper dust to the nozzle orifices, the probability of nozzle clogging occurring can be reduced.

As illustrated in FIGS. 19 and 20, in the third embodiment the first through holes 335*a* are located in the first regions 51 (i.e., below the ejection regions 345*a* of the head surfaces) and the second through holes 335*b* are located in the second regions 52 (i.e., below the non-ejection regions 345*b* of the head surfaces). The above configuration ensures that suction force acting on the sheet P below each of the recording heads 341, 342, 343, and 344 is not insufficient.

Note that in the same way as explained for the first embodiment, the second through holes 335*b* may have a greater density than the first through holes 335*a*. Also, the second through holes 335*b* may have a greater cross-sectional area than the first through holes 335*a*. Also, the second through holes 335*b* may be shallower than the first through holes 335*a*. Furthermore, the first through holes 335*a* and the second through holes 335*b* may exhibit any combination of the aforementioned features.

Figure 21:
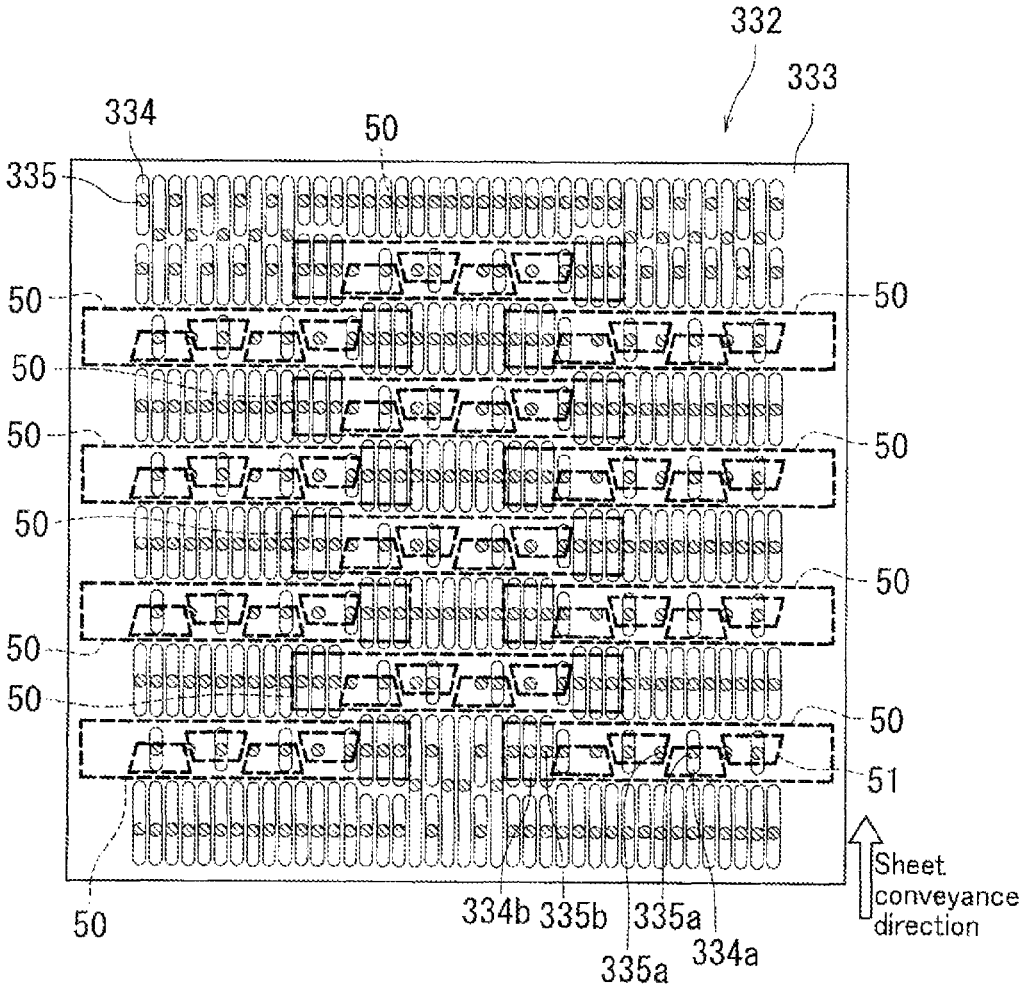
FIG. 21 is a plan view illustrating a guide member according to another embodiment of the present disclosure.

Matter explained in the first, second, and third embodiments may be combined as appropriate. For example, first through holes 335*a* located outside of grooves 334 and first through holes 335*a* located inside of first grooves 334*a* may both be present as illustrated in FIG. 21.

Specific embodiments of the present disclosure are explained above, but the present disclosure is of course not limited to the above embodiments and various alterations can be made to the embodiments.

For example, although the first through holes 335*a* and the second through holes 335*b* each have a circular cross-section in the embodiments, the cross-sectional shape of the first through holes 335*a* and the second through holes 335*b* is not limited to being circular. For example, the first through holes 335*a* and the second through holes 335*b* may each have a rectangular cross-section.

The embodiments are explained for a situation in which the present disclosure is applied to a line head inkjet recording apparatus, but the present disclosure can also be applied to a serial head inkjet recording apparatus.

In the embodiments, three recording heads are arranged for each color in a staggered formation along the direction perpendicular to the sheet conveyance direction, but there is no particular limitation on the number of recording heads for each of the colors. For example, a single recording head may be provided for each of the colors. Also, in a configuration in which a plurality of recording heads are provided for each of the colors, the plurality of recording heads for each of the colors are not limited to being arranged in a staggered formation and may instead be arranged in a single line along the direction perpendicular to the sheet conveyance direction.

The embodiments are explained for a situation in which the present disclosure is applied to an inkjet recording apparatus that is capable of forming a full-color image, but the present disclosure can also be applied to an inkjet recording apparatus that forms a monochrome image.

Although the embodiments are explained for a situation in which the present disclosure is applied to an inkjet recording apparatus, the present disclosure can also be applied to other image forming apparatuses (for example, an electrophotographic image forming apparatus).

Furthermore, although the embodiments are explained for a situation in which the recording medium is a sheet of paper, the recording medium may be a medium other than a sheet of paper (for example, a resin sheet or cloth).

In addition to the alterations explained above, a wide range of other alterations can be made to the embodiments so long as such alterations do not deviate from the intended scope of the present disclosure.

What is claimed is:

1. A conveyor device for installation opposite to a recording head in a recording apparatus, the conveyor device comprising:

a conveyor belt configured to convey a recording medium; and a suction section configured to suck on the recording medium through the conveyor belt and a guide member of the suction section that is located opposite to the recording head with the conveyor belt therebetween, the guide member having a plurality of through holes therein, wherein the guide member has a surface with a plurality of grooves therein that faces toward the recording head with the conveyor belt therebetween, the through holes are each located inside of a corresponding one of the grooves, the recording head is fixed in place, the recording head has an ejection region and a non-ejection region, the recording head ejects ink droplets from the ejection region, the surface of the guide member has a head facing region located directly under the recording head, the head facing region having a first region located directly under the ejection region and a second region located directly under the non-ejection region, the through holes include a first through hole within the first region, and a second through hole within the second region, the grooves include a first groove and a second groove, the first through hole is located inside of the first groove, the second through hole is located inside of the second groove, and the second groove is longer than the first groove.

2. The conveyor device according to claim 1, wherein the first groove is shorter than the recording head.

3. The conveyor device according to claim 1, wherein the second groove is longer than the recording head.

4. The conveyor device according to claim 1, wherein the second groove has a greater cross-sectional area than the first groove.

5. The conveyor device according to claim 1, wherein the second groove has a greater aperture area than the first groove.

6. The conveyor device according to claim 1, wherein the second through hole has a greater cross-sectional area than the first through hole.

7. The conveyor device according to claim 1, wherein the second through hole is shallower than the first through hole.

* * * * *